US012788119B2

(12) United States Patent
Ng et al.

(10) Patent No.: US 12,788,119 B2
(45) Date of Patent: Nov. 10, 2026

(54) CONTAINER ASSEMBLIES AND METHODS FOR FORMING THE SAME

(71) Applicant: Casetagram Limited, Hong Kong (HK)

(72) Inventors: Pui Sun Wesley Ng, Kowloon (HK); Scott Lewis Davis, Kowloon (HK)

(73) Assignee: Casetagram Limited, Hong Kong (HK)

( * ) Notice: Subject to any disclaimer, the term of this patent is extended or adjusted under 35 U.S.C. 154(b) by 0 days.

(21) Appl. No.: 18/775,157

(22) Filed: Jul. 17, 2024

(65) Prior Publication Data

US 2026/0020653 A1 Jan. 22, 2026

(51) Int. Cl.
*A45C 13/00* (2006.01)
*A45C 13/04* (2006.01)

(52) U.S. Cl.
CPC ..... *A45C 13/001* (2013.01); *A45C 13/04* (2013.01)

(58) Field of Classification Search
CPC ..... A45C 13/001; A45C 13/08; A45C 13/04; A45C 5/00; A45C 5/03
USPC ..... 190/100, 102; 206/459.5; 40/124.06, 40/722, 700
See application file for complete search history.

(56) References Cited

U.S. PATENT DOCUMENTS

| | | | |
|---|---|---|---|
| 2,080,453 | A | 5/1937 | Kraut |
| 2,302,560 | A | 11/1942 | Latona |
| 2,484,661 | A | 10/1949 | Vogel |
| 2,522,549 | A | 9/1950 | Waggoner |
| 2,694,427 | A | 11/1954 | Hovis |
| 2,809,685 | A | 10/1957 | Lowy |
| 2,845,974 | A | 8/1958 | Arden |
| 2,916,841 | A | 12/1959 | Denis |
| 2,986,832 | A | 6/1961 | White |
| 3,182,701 | A | 5/1965 | Ginsburg |
| 3,234,985 | A | 2/1966 | Gilbert |
| 3,575,226 | A | 4/1971 | Chapman |
| 3,623,580 | A | 11/1971 | Toller |
| 4,027,710 | A | 6/1977 | Keebler |
| 4,033,243 | A | 7/1977 | Kirrish et al. |
| 4,270,590 | A | 6/1981 | Marshall |
| 4,310,273 | A | 1/1982 | Kirrish |
| 4,490,083 | A | 12/1984 | Rebish |
| 4,598,802 | A | 7/1986 | Abenaim |
| 5,178,245 | A | 1/1993 | Cox |
| 5,222,642 | A | 6/1993 | Solarz |

(Continued)

FOREIGN PATENT DOCUMENTS

| | | | |
|---|---|---|---|
| BR | 202013011322 | U2 | 6/2018 |
| CN | 201188950 | Y | 2/2009 |

(Continued)

OTHER PUBLICATIONS

International Search Report and Written Opinions of PCT Patent Application No. PCT/CN2025/104930 issued on Sep. 24, 2025.

*Primary Examiner* — Robert Poon

(57) ABSTRACT

The assembly includes a first subassembly connected to a second subassembly. The first subassembly includes a frame removably-connected to a trim panel. The frame has a frame front surface and a frame rear surface. The trim panel has a trim panel front surface and a trim panel rear surface. The frame rear surface is arranged opposite one of the trim panel front surface and the trim panel rear surface. A method is also disclosed.

16 Claims, 11 Drawing Sheets

(56) References Cited

U.S. PATENT DOCUMENTS 5,255,765 A 10/1993 Schrecongost
5,533,558 A 7/1996 Carey et al.
5,718,336 A * 2/1998 Haarlander ..... A45C 13/08 206/541
5,836,095 A 11/1998 Crowell
6,029,723 A 2/2000 Baquero et al.
6,050,373 A 4/2000 Wonka et al.
6,129,126 A 10/2000 Restivo
6,173,837 B1 1/2001 Marconi
6,179,025 B1 1/2001 Sutton
6,186,201 B1 2/2001 Salz
6,202,846 B1 3/2001 Hess
6,231,233 B1 5/2001 Orce
6,234,287 B1 5/2001 Pfeiffer
6,312,126 B1 11/2001 Yoshida
6,340,235 B1 1/2002 Bryan
6,390,714 B1 * 5/2002 Bradley ..... B42F 5/005 281/38
6,446,688 B1 9/2002 Sutton
6,543,499 B2 4/2003 McCreery
6,547,436 B2 4/2003 Sutton
6,820,664 B1 11/2004 Ritch
7,028,730 B2 4/2006 Pace et al.
7,086,437 B1 8/2006 Michael
7,222,649 B1 5/2007 Fox
7,240,778 B2 7/2007 Duncanson et al.
7,296,665 B2 11/2007 Morszeck
7,607,461 B2 10/2009 Pace et al.
7,789,114 B2 9/2010 Pace et al.
7,905,038 B2 3/2011 Coff
7,913,849 B2 3/2011 Pedrazzi et al.
7,946,322 B2 5/2011 Valvano et al.
D639,057 S 6/2011 Presman et al.
8,156,974 B2 4/2012 Pace et al.
D658,366 S 5/2012 Platt et al.
D659,389 S 5/2012 Platt et al.
8,251,113 B2 8/2012 Baxter
D673,362 S 1/2013 Presman et al.
8,636,122 B2 1/2014 Smith et al.
8,684,053 B2 4/2014 Platt et al.
8,684,054 B2 4/2014 Platt et al.
8,802,001 B2 8/2014 Hou
D714,057 S 9/2014 Hou
8,894,788 B2 11/2014 Lee
8,931,191 B2 * 1/2015 Masanek, Jr. ..... B60R 13/105 40/209
9,066,566 B2 6/2015 Lai
9,198,489 B2 12/2015 Romero et al.
9,266,306 B2 2/2016 Lee
9,353,778 B2 5/2016 Chalverat
9,380,845 B2 7/2016 Sheikh et al.
9,480,315 B2 11/2016 Goodale
9,603,439 B2 3/2017 Nakamura
9,622,559 B2 4/2017 Pace et al.
9,687,054 B2 6/2017 Platt et al.
9,693,620 B2 7/2017 Donahue
9,788,623 B1 10/2017 Chen
9,877,558 B1 1/2018 Harstvedt
9,901,150 B2 2/2018 Fenton
9,986,813 B2 6/2018 Nakamura
10,070,709 B1 9/2018 Polins et al.
10,188,185 B2 1/2019 Wu
10,575,613 B2 3/2020 Pace et al.
10,624,434 B2 4/2020 Josifov
10,736,404 B2 8/2020 Kapavik
10,813,436 B2 10/2020 Hall
10,881,189 B2 1/2021 Jones et al.
10,993,517 B2 5/2021 Ma et al.
D952,328 S 5/2022 Hedaya
11,324,304 B2 5/2022 Assa-Darko
11,432,628 B2 9/2022 Fabbri
11,528,972 B2 12/2022 Leguillou et al.
2007/0108005 A1 5/2007 Augenstein et al.
2007/0137959 A1 6/2007 Zauderer
2007/0208617 A1 9/2007 Toker
2007/0221136 A1 9/2007 Buttner
2007/0289681 A1 12/2007 Bond
2008/0087360 A1 4/2008 Duke
2009/0008202 A1 1/2009 Dayton et al.
2009/0025842 A1 1/2009 Courville
2009/0314595 A1 12/2009 Miller et al.
2010/0252152 A1 10/2010 Stupski
2010/0252153 A1 10/2010 Pace et al.
2011/0132707 A1 6/2011 Davis, Sr. et al.
2012/0097495 A1 4/2012 Moore
2012/0175030 A1 7/2012 Pace et al.
2013/0108392 A1 * 5/2013 Henriksen, Jr. ..... F16B 33/002 411/166
2013/0220845 A1 8/2013 Smith
2014/0224608 A1 8/2014 Tang
2015/0296945 A1 10/2015 Douglas
2016/0007719 A1 1/2016 Harstvedt
2016/0249716 A1 9/2016 Ghantous et al.
2016/0249717 A1 9/2016 Ocleppo
2017/0020254 A1 1/2017 Kim
2017/0135453 A1 5/2017 Lo et al.
2017/0150791 A1 6/2017 Ocleppo
2017/0156462 A1 6/2017 Yu
2017/0360168 A1 12/2017 Boroski et al.
2018/0177270 A1 6/2018 Gordon
2019/0008256 A1 1/2019 Basham
2019/0289974 A1 9/2019 Rifkind
2020/0178659 A1 6/2020 Baugh
2022/0369778 A1 11/2022 Pereira
2023/0104899 A1 * 4/2023 Lin ..... A45C 5/03 190/122
2023/0148720 A1 5/2023 Carter
2023/0172343 A1 6/2023 Osborne et al.
2023/0292899 A1 9/2023 Wilson et al.
2024/0065401 A1 * 2/2024 Valtanen ..... A45C 13/10

FOREIGN PATENT DOCUMENTS

CN 201319940 Y 10/2009
CN 102695434 B 2/2015
CN 204232442 U 4/2015
CN 205410071 U 8/2016
CN 207220376 U 4/2018
CN 108260911 A 7/2018
CN 208064701 U 11/2018
CN 208080708 U 11/2018
CN 110001976 A 7/2019
CN 209346220 U 9/2019
CN 209547248 U 10/2019
CN 213030059 U 4/2021
CN 215455939 U 1/2022
CN 217075434 U 7/2022
CN 217487860 U 9/2022
DE 202011004926 U1 6/2011
FR 1108023 A 1/1956
FR 2654312 A1 5/1991
GB 419184 A 11/1934
GB 2474528 A 4/2011
IN 202311050134 8/2023
JP 3171202 U 10/2011
KR 1020130079324 A 7/2013
WO 03/055346 A2 7/2003
WO 2003055346 A2 7/2003
WO 2010066122 A1 6/2010
WO 2011127784 A1 10/2011
WO 2017132598 A1 8/2017
WO 2021176185 A1 9/2021

* cited by examiner

CONTAINER ASSEMBLIES AND METHODS FOR FORMING THE SAME

TECHNICAL FIELD

The present disclosure relates generally to container assemblies and methods for forming the same.

BACKGROUND

This section provides background information related to the present disclosure and is not necessarily prior art.

While known container assemblies have proven to be acceptable for various applications, container assemblies are nevertheless susceptible to improvements that may enhance their overall performance and cost. Therefore, a need exists to develop improved container assemblies that advance the art.

SUMMARY

One aspect of the disclosure provides an assembly. The assembly includes a first subassembly connected to a second subassembly. The first subassembly includes a frame removably-connected to a trim panel. The frame has a frame front surface and a frame rear surface. The trim panel has a trim panel front surface and a trim panel rear surface. The frame rear surface is arranged opposite one of the trim panel front surface and the trim panel rear surface.

Implementations of the disclosure may include one or more of the following optional features. In some implementations, the frame includes one or more lugs that extend from the frame rear surface. The trim panel includes one or more trim panel passages that extend through the trim panel. The frame is removably-connected to the trim panel by arranging the one or more lugs of the frame though the one or more trim panel passages. A portion of the one or more lugs extend beyond the trim panel rear surface.

In some examples, the assembly further includes a container. The container has a container front surface and a container rear surface. The container includes one or more container passages that extend through the container. The trim panel rear surface is arranged opposite the container front surface. The portion of the one or more lugs that extend beyond the rear surface of the trim panel is arranged within the one or more container passages of the container for connecting the first subassembly to the container for forming the second subassembly. The one or more lugs of the frame is friction-fit connected to: the one or more trim panel passages of the trim panel; and the one or more container passages of the container.

In other examples, the assembly includes one or more fasteners. The one or more fasteners are connected to: the one or more lugs; and the container for selectively-securing and removably-connecting the frame to the container. The one or more fasteners include a threaded fastener having a head portion and a threaded stem portion extending from the head portion. The one or more lugs include a threaded surface that defines a threaded cavity. The threaded stem portion is disposed within the threaded cavity. The head portion is disposed opposite the container rear surface.

In further examples, the one or more fasteners include a snap fastener or a magnet. The snap fastener is connected to the container rear surface by a tether or hinge. The magnet is connected to the container rear surface by a tether or hinge.

In even further examples, the frame further includes a frame inner side surface that connects the frame front surface to the frame rear surface. The frame inner side surface defines a frame opening. The assembly further includes: a first design arranged upon the trim panel front surface; and a second design arranged upon the trim panel rear surface. The trim panel front surface includes: a first surface portion; and a second surface portion. The at least the second surface portion of the trim panel front surface includes the first design. The frame rear surface is arranged opposite at least the first portion of the trim panel front surface. The frame opening exposes the first design included on at least the second surface portion of the trim panel front surface. The trim panel rear surface includes: a first surface portion; and a second surface portion. At least the second surface portion of the trim panel rear surface includes the second design. The frame rear surface is arranged opposite at least the first portion of the trim panel rear surface. The frame opening exposes the second design included on at least the second surface portion of the trim panel rear surface.

Another aspect of the disclosure provides a method for assembling an assembly. The method includes connecting a first subassembly connected to a second subassembly. The first subassembly includes a frame removably-connected to a trim panel. The frame includes a frame front surface and a frame rear surface. The trim panel includes a trim panel front surface and a trim panel rear surface. The method further includes assembling the first subassembly by arranging the frame rear surface opposite one of: the trim panel front surface; and the trim panel rear surface.

Implementations of the disclosure may include one or more of the following optional features. In some implementations, the frame includes one or more lugs that extend from the frame rear surface. The trim panel includes one or more trim panel passages that extend through the trim panel. The frame is removably-connected to the trim panel by: arranging the one or more lugs of the frame though the one or more trim panel passages for connecting the frame to the trim panel; and arranging a portion of the one or more lugs extend beyond the trim panel rear surface. The second subassembly includes a container having a container front surface and a container rear surface. The container includes one or more container passages that extend through the container. The method further includes: arranging the trim panel rear surface opposite the container front surface; and arranging the portion of the one or more lugs that extend beyond the rear surface of the trim panel within the one or more container passages of the container for connecting the first subassembly to the container for forming the second subassembly.

In some examples, the method includes friction-fit connecting the one or more lugs of the frame to: the one or more trim panel passages of the trim panel; and the one or more container passages of the container. Alternatively, the method includes selectively-securing the frame to the container with the one or more fasteners.

In other examples, the method further includes arranging a first design upon the trim panel front surface; and arranging a second design upon the trim panel rear surface. The trim panel front surface includes a first surface portion and a second surface portion. At least the second surface portion of the trim panel front surface includes the first design. The method further includes: arranging the frame rear surface opposite at least the first portion of the trim panel front surface; and utilizing the frame opening for exposing the first design included on at least the second surface portion of the trim panel front surface.

In further examples, the method further includes arranging a first design upon the trim panel front surface; and arranging a second design upon the trim panel rear surface. The trim panel rear surface includes a first surface portion and a second surface portion. At least the second surface portion of the trim panel rear surface includes the second design. The method further includes: arranging the frame rear surface opposite at least the first portion of the trim panel rear surface; and utilizing the frame opening for exposing the second design included on at least the second surface portion of the trim panel rear surface.

The details of one or more implementations of the disclosure are set forth in the accompanying drawings and the description below. Other aspects, features, and advantages will be apparent from the description and drawings, and from the claims.

DESCRIPTION OF DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

Corresponding reference numerals indicate corresponding parts throughout the drawings.

DETAILED DESCRIPTION

The present disclosure relates generally to one or more assemblies and methods for forming the same. As will be explained in the following disclosure, the one or more assemblies may be sized, shaped, or function as luggage, a suitcase, a briefcase, a handbag, a purse, a backpack, a rucksack, a lunchbox, or the like. Accordingly, in some instances, each of the one or more assemblies may be alternatively referred as a container assembly.

Figure 1:
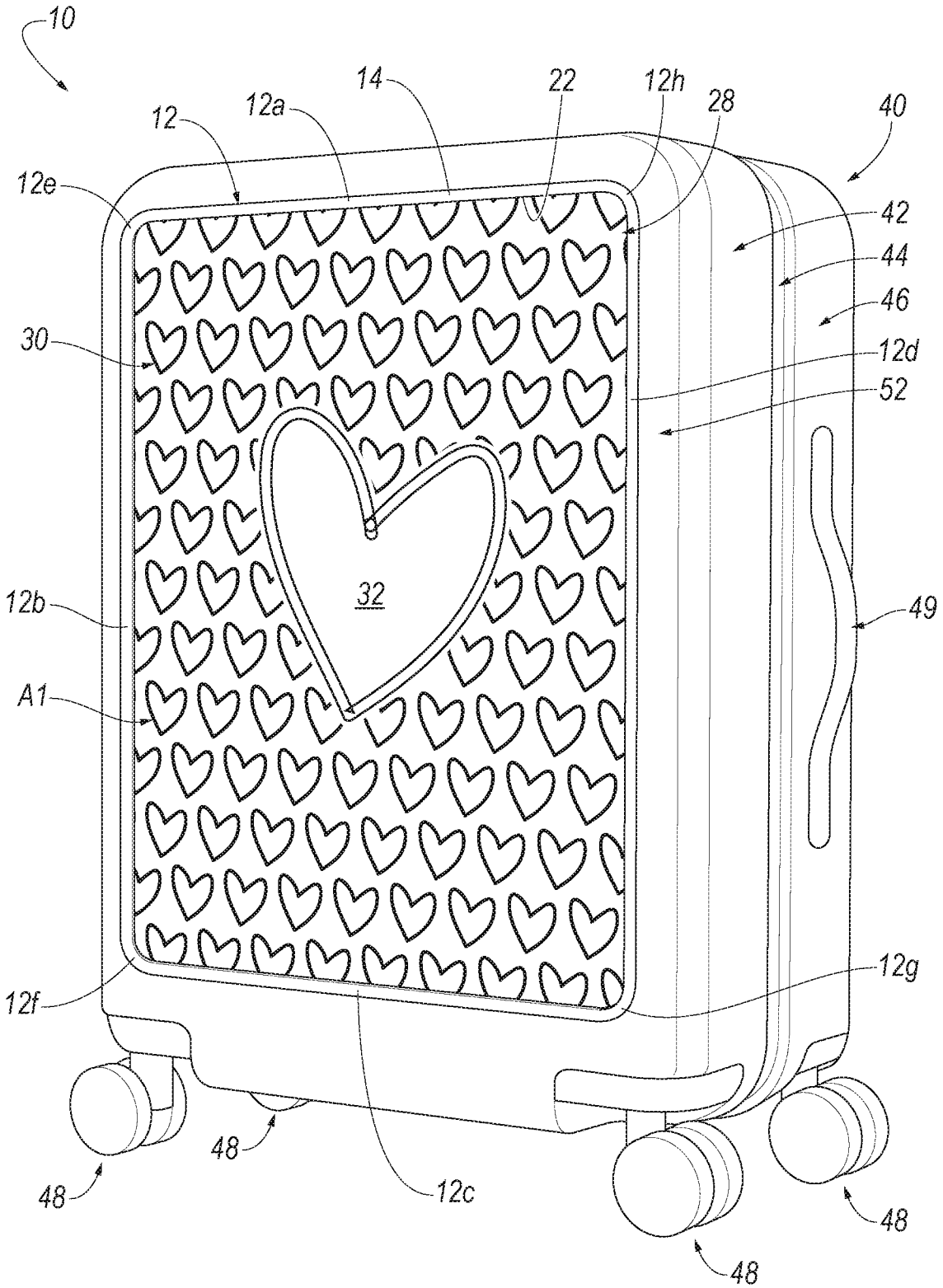
FIG. 1 is a front perspective view of an assembly including a container, a trim panel, and a frame that retains the trim panel to the container.

Referring to FIG. 1, an assembly 10 includes a frame 12. As seen also at FIGS. 2 and 4, the frame 12 may include any desirable shape (e.g., a rectangle, a square, a circle, a triangle, or the like).

Figure 4:
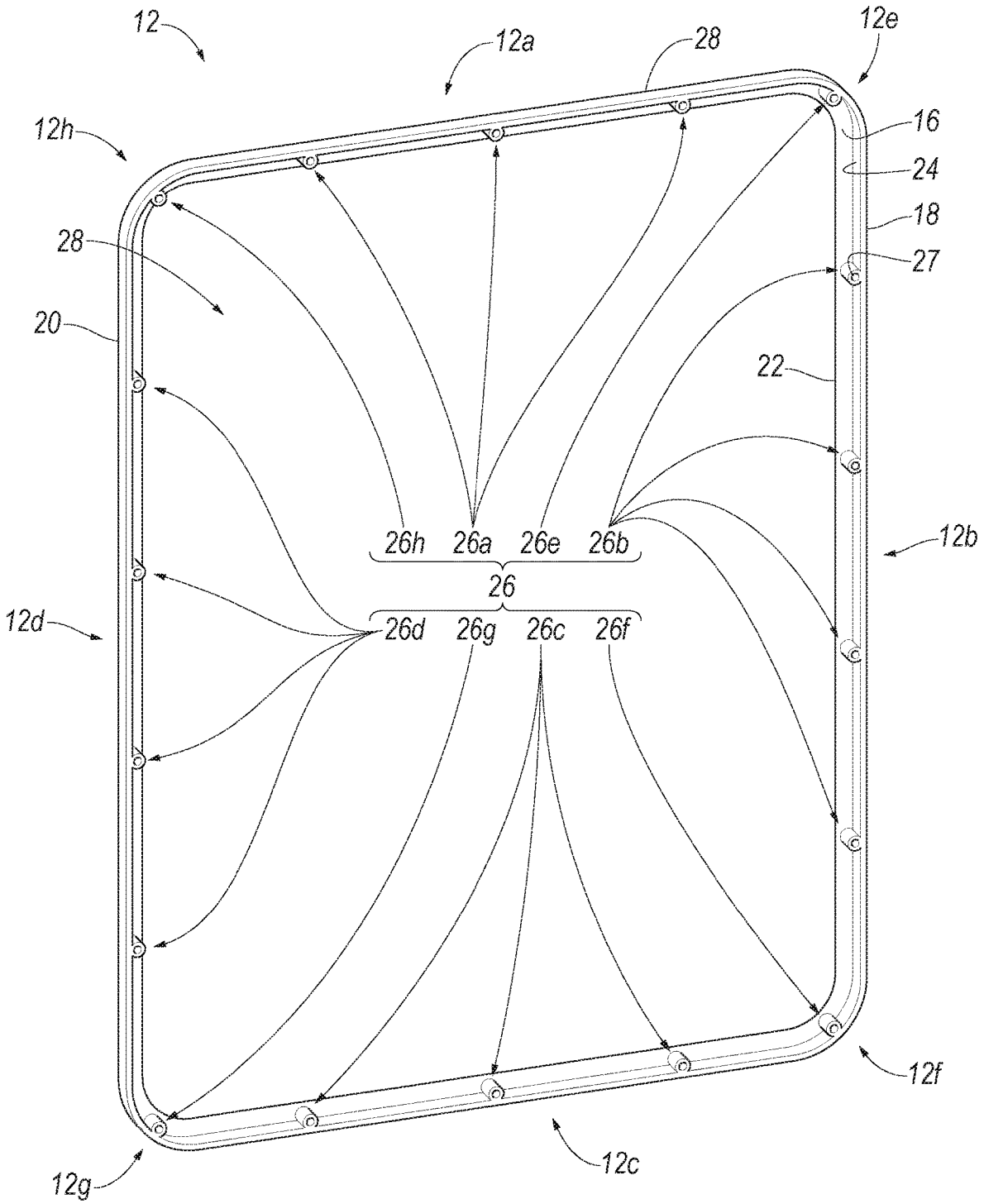
FIG. 4 is a rear perspective view of the frame of the assembly of FIGS. 1 and 2.

In some implementations, as seen at, for example, FIGS. 1 and 4, the frame 12 may include a substantially rectangular shape having a first end segment 12*a* that is opposite a second end segment 12*c*. The frame 12 may further include a first side segment 12*b* that is opposite a second side segment 12*d*. Furthermore, in some configurations, the frame 12 may include a first corner segment 12*e*, a second corner segment 12*f*, a third corner segment 12*g*, and a fourth corner segment 12*h*. Each of the corner segments 12*e*-12*h* may include, for example, an arcuate shape. The first corner segment 12*e* connects the first end segment 12*a* to the first side segment 12*b*. The second corner segment 12*f* connects the first side segment 12*b* to the second end segment 12*c*. The third corner segment 12*g* connects the second end segment 12*c* to the second side segment 12*d*. The fourth corner segment 12*h* connects the second side segment 12*d* to the first end segment 12*a*.

Referring now to FIGS. 1-4, other exemplary aspects of the frame 12 are now described. In some configurations, the frame 12 is further defined by: a front surface 14 (see, e.g., FIGS. 1, 2 and 3A-3D); a first rear surface 16 (see, e.g., FIGS. 2, 3A-3D, and 4); a second rear surface 18 (see, e.g., FIGS. 2, 3A-3D, and 4); an outer side surface 20 (see, e.g., FIGS. 2, 3A-3D, and 4); a first inner side surface 22 (see, e.g., FIGS. 2, 3A-3D, and 4); and a second inner side surface 24 (see also, e.g., FIGS. 2, 3A-3D, and 4).

Figure 2:
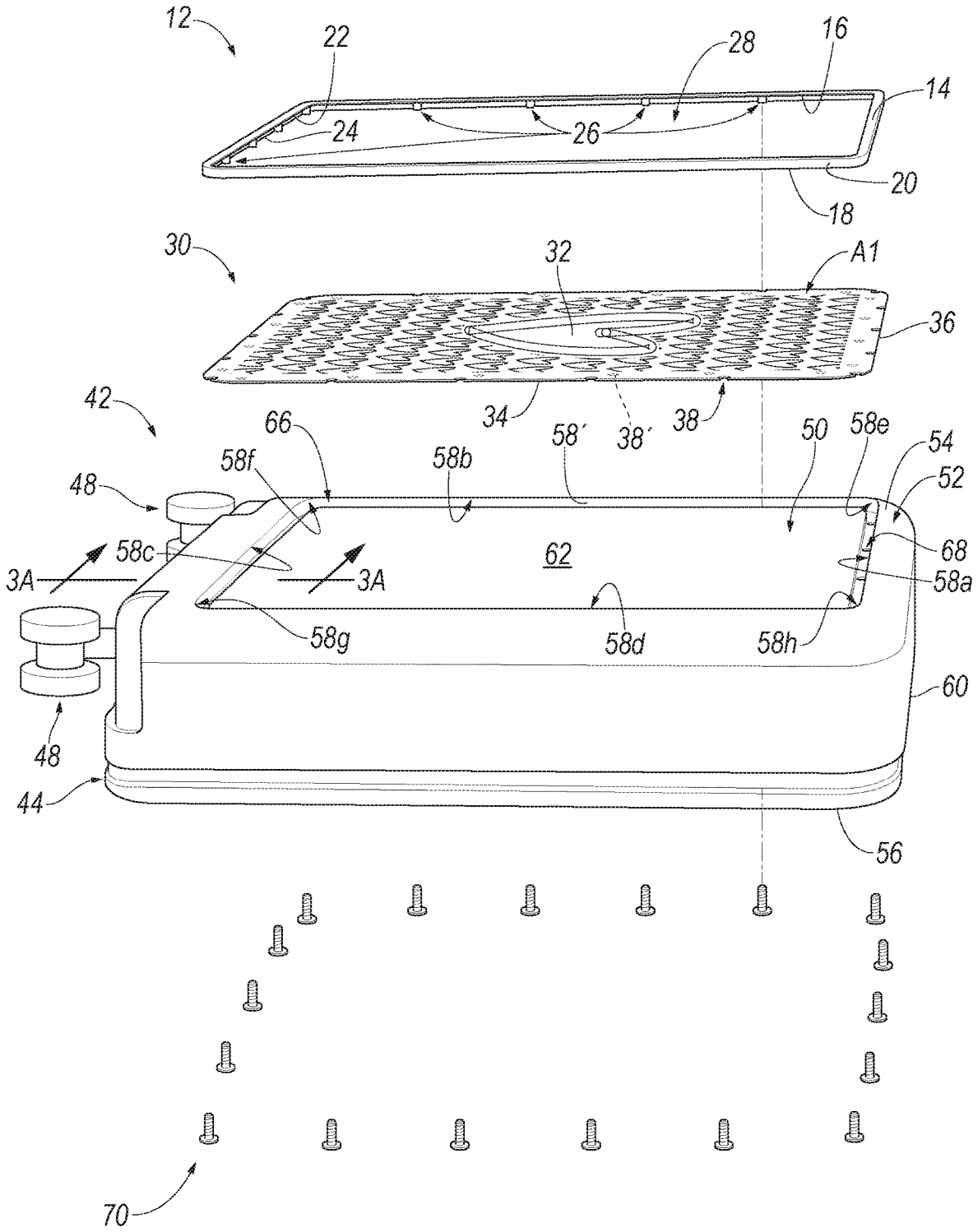
FIG. 2 is a partial and exploded side perspective view of the assembly of FIG. 1.
Figure 3B:
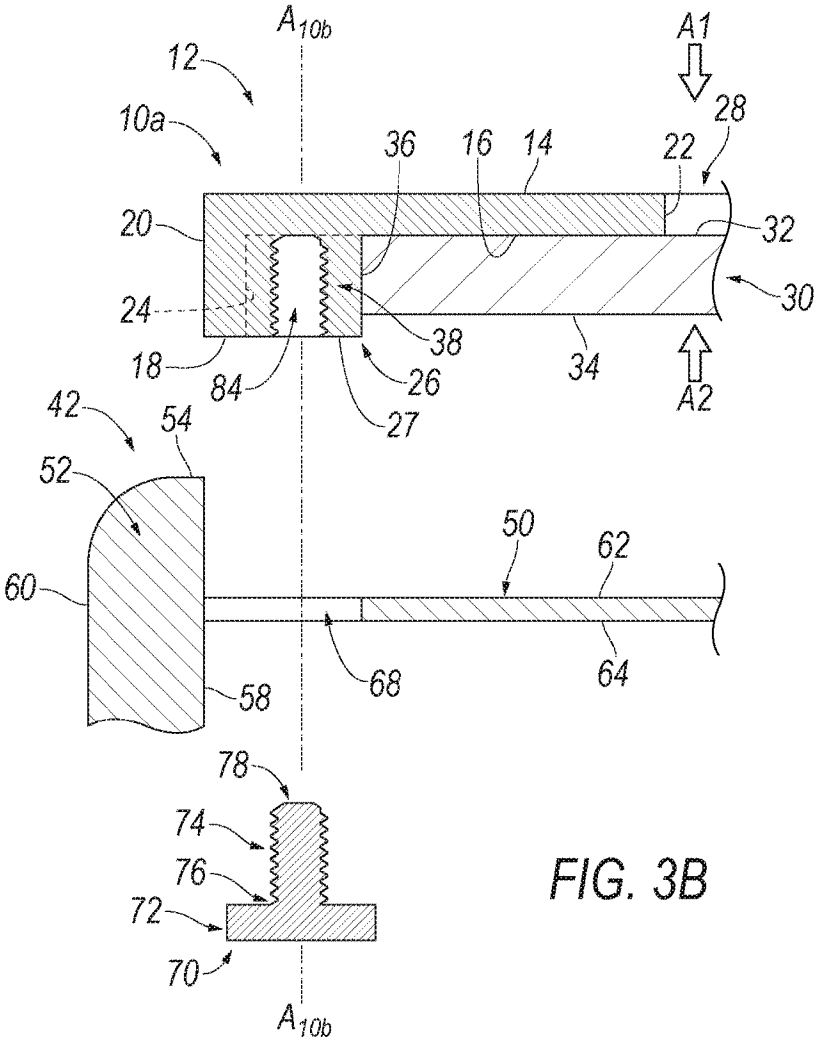
FIG. 3B is a cross-sectional view of the assembly according to FIG. 3A in a partially assembled state.
Figure 3A:
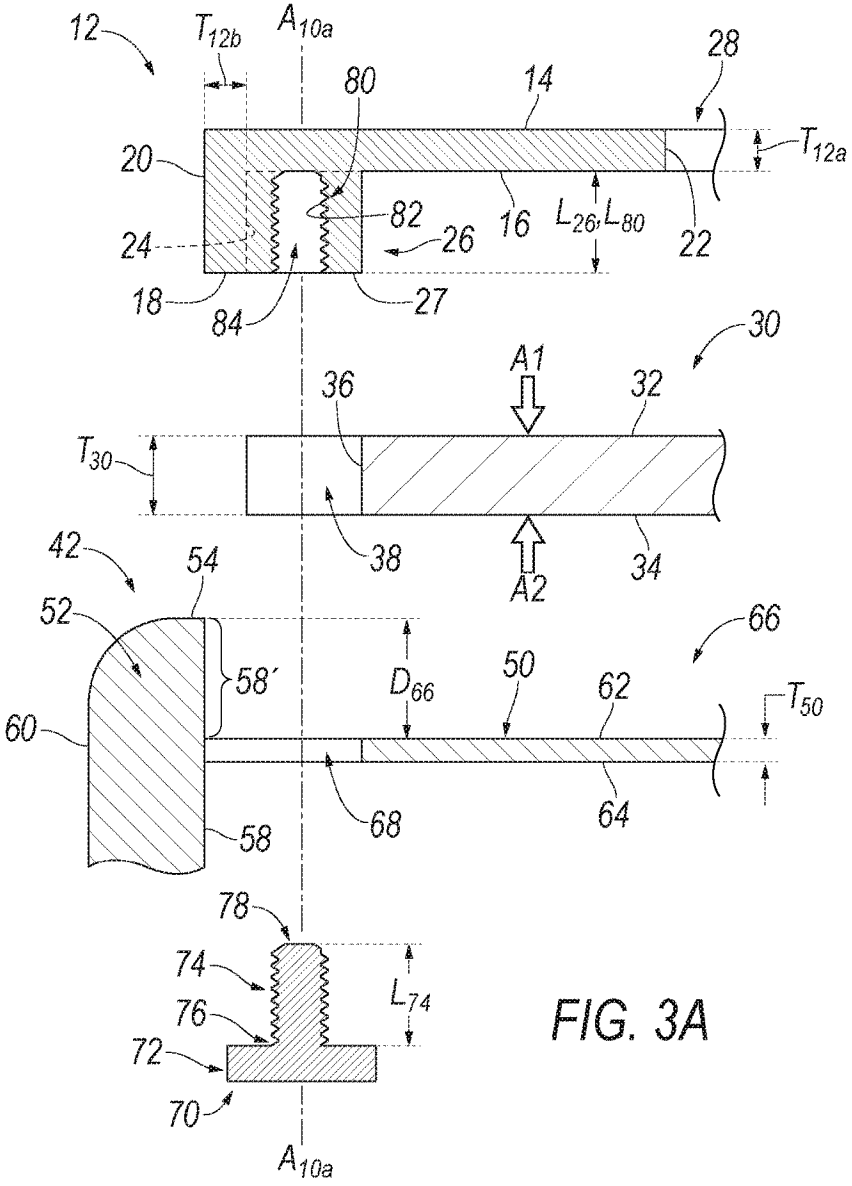
FIG. 3A is a cross-sectional view of the assembly according to line 3A-3A of FIG. 2.

As seen at, for example, FIG. 3A, the front surface 14 is connected to the second inner side surface 22. The second inner side surface 22 is connected to the first rear surface 16. The first rear surface 16 is connected to the second inner side surface 24 (see also, e.g., FIGS. 2 and 4). The second inner side surface 24 is connected to the second rear surface 18. The second rear surface 18 is connected to the outer side surface 20. The outer side surface 20 is connected to the front surface 14.

With continued reference to FIG. 3A, the first rear surface 16 is opposite the front surface 14 and defines a first thickness T12*a* of the frame 12 extending along the first inner side surface 22 that connects the front surface 14 to the first rear surface 16. The second inner side surface 24 is opposite the outer side surface 20 and defines a second thickness T12*b* of the frame 12 extending along the second rear surface 18 that connects the second inner side surface 24 to the outer side surface 20.

Referring to FIGS. 2, 3A-3D, and 4, the frame 12 may include one or more lugs 26.

With reference to FIGS. 3A-3D and 4, in some examples, the one or more lugs 26 extend from one or more of: (1) the first rear surface 16 of the frame 12; (2) the second rear surface 18 of the frame 12; and (3) the second inner side surface 24 of the frame 12. Each lug 26 may include a distal end surface 27 that may be aligned with and extend from the second rear surface 18 of the frame 12.

As seen at, for example, FIG. 3A, the one or more lugs 26 may be defined by a length $L_{26}$ extending between the first rear surface 16 of the frame 12 and the distal end surface 27 of each lug 26. The one or more lugs 26 may include any desirable shape such as, for example, a substantially cylindrical shape or tube shape.

With reference to FIG. 4, the one or more lugs 26 may be selectively arranged about and extend from an inner-rear periphery of the frame 12 defined by: (A) the first rear surface 16; (B) the second rear surface 18; and (C) the second inner side surface 24. In some implementations, the one or more lugs 26 may include, for example: (1) at least one lug 26*a* extending from one or more of the first rear surface 16, the second rear surface 18, and the second inner side surface 24 of the first end segment 12*a* of the frame 12; (2) at least one lug 26*b* extending from one or more of the first rear surface 16, the second rear surface 18, and the second inner side surface 24 of the first side segment 12*b* of the frame 12; (3) at least one lug 26*c* extending from one or more of the first rear surface 16, the second rear surface 18, and the second inner side surface 24 of the second end segment 12*c* of the frame 12; (4) at least one lug 26*d* extending from one or more of the first rear surface 16, the second rear surface 18, and the second inner side surface 24 of the second side segment 12*d* of the frame 12; (5) at least one lug 26*e* extending from one or more of the first rear surface 16, the second rear surface 18, and the second inner side surface 24 of the first corner segment 12*e* of the frame 12; (6) at least one lug 26*f* extending from one or more of the first rear surface 16, the second rear surface 18, and the second inner side surface 24 of the second corner segment 12*f* of the frame 12; (7) at least one lug 26*g* extending from one or more of the first rear surface 16, the second rear surface 18, and the second inner side surface 24 of the third corner segment 12*g* of the frame 12; and (8) at least one lug 26*h* extending from one or more of the first rear surface 16, the second rear surface 18, and the second inner side surface 24 of the fourth corner segment 12*h* of the frame 12.

In some implementations as seen at, for example, FIG. 4: (1) each of the segments 12*a*, 12*c* of the frame 12 includes, respectively, three lugs 26*a*, 26*c*; (2) each of the segments 12*b*, 12*d* of the frame 12 includes, respectively, four lugs 26*b*, 26*d*; and (3) each of the corner segments 12*e*, 12*f*, 12*g*, 12*h* of the frame 12 includes, respectively, one lug 26*e*, 26*f*, 26*g*, 26*h*. Accordingly, the frame 12 may include a total of eighteen lugs 26 extending from one or more of the first rear surface 16, the second rear surface 18, and the second inner side surface 24 of the frame 12.

Referring to FIGS. 1-4, the first inner side surface 22 of the frame 12 defines a frame opening 28. Because the segments 12*a*-12*h* of the frame contribute to forming a substantially rectangular shape, the frame opening 28 is also defined by a substantially rectangular shape.

Referring to FIG. 1, the assembly 10 further includes a trim panel 30. As seen also at FIGS. 2, 3A-3D, and 5A-5B, the trim panel 30 may include any desirable shape (e.g., a rectangle, a square, a circle, a triangle, or the like).

Figure 5B:
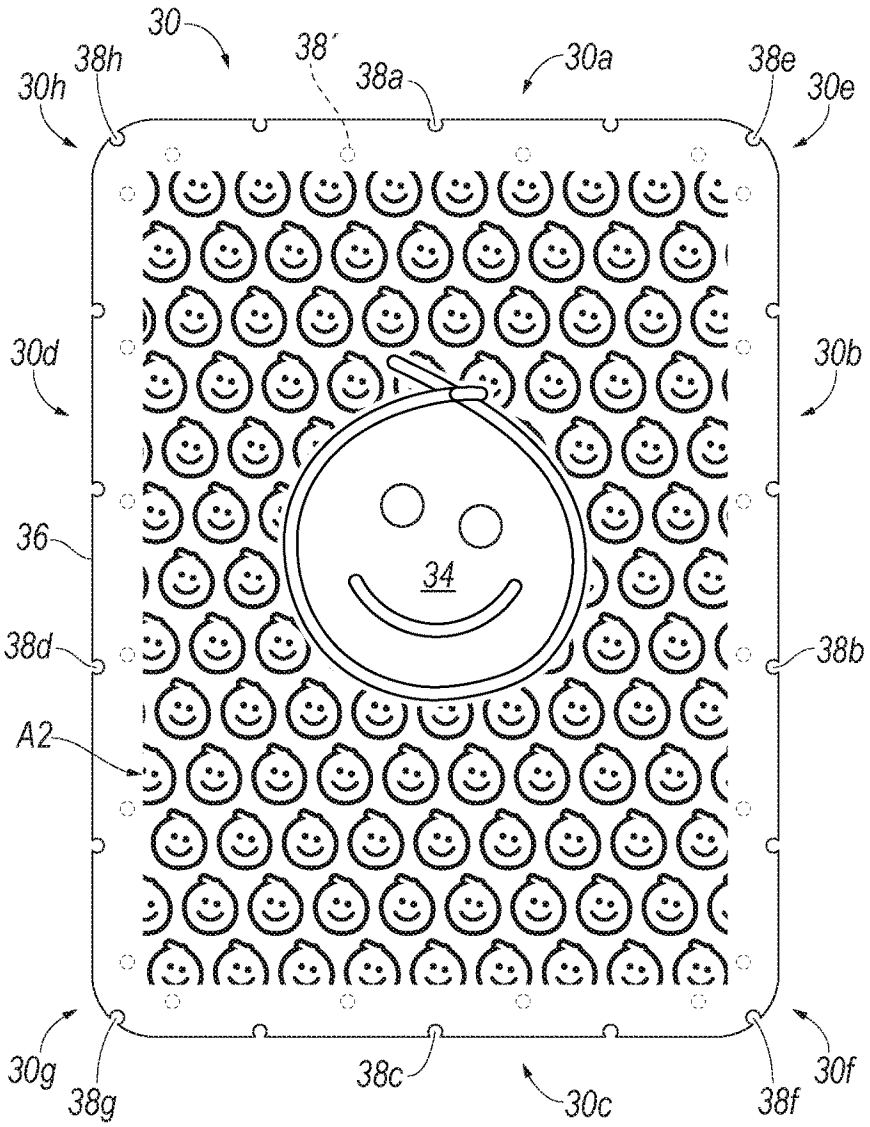
FIG. 5B is a rear view of the trim panel of FIG. 5A.
Figure 5A:
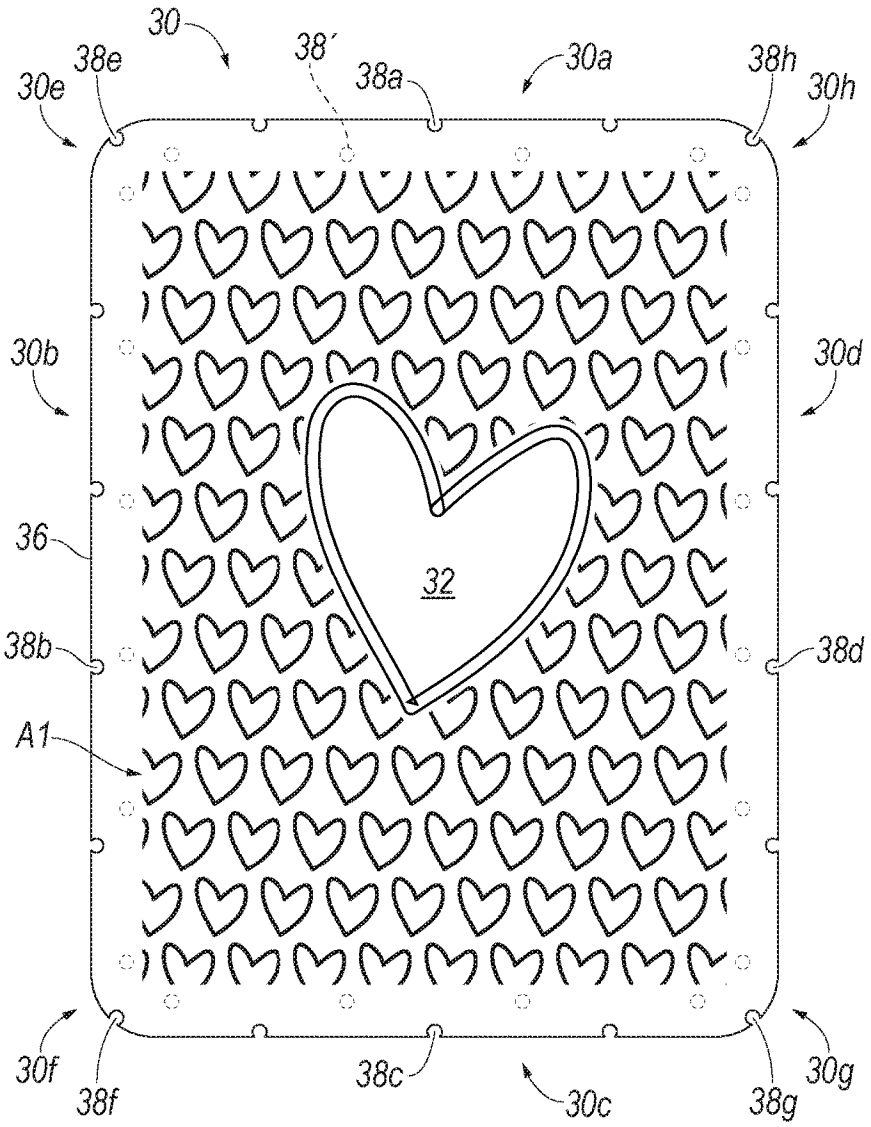
FIG. 5A is a front view of the trim panel of the assembly of FIGS. 1 and 2 having an arrangement of passages that are configured to receive a corresponding arrangement of lugs extending from the frame of the assembly of FIGS. 1 and 2.

In some implementations, as seen at, for example, FIGS. 5A and 5B, the trim panel 30 may include a substantially rectangular shape having a first end segment 30*a* that is opposite a second end segment 30*c*. The trim panel 30 may further include a first side segment 30*b* that is opposite a second side segment 30*d*. Furthermore, in some configurations, the trim panel 30 may include a first corner segment 30*e*, a second corner segment 30*f*, a third corner segment 30*g*, and a fourth corner segment 30*h*. Each of the corner segments 30*e*-30*h* may include, for example, an arcuate shape. The first corner segment 30*e* connects the first end segment 30*a* to the first side segment 30*b*. The second corner segment 30*f* connects the first side segment 30*b* to the second end segment 30*c*. The third corner segment 30*g* connects the second end segment 30*c* to the second side segment 30*d*. The fourth corner segment 30*f* connects the second side segment 30*d* to the first end segment 30*a*.

Referring now to FIGS. 1-3D and 5A-5B, other exemplary aspects of the trim panel 30 are now described. In some configurations, the trim panel 30 is further defined by: a front surface 32 (see, e.g., FIGS. 2, 3A-3D, 5A, and 5B); a rear surface 34 (see, e.g., FIGS. 2 and 3A-3D, and 5B); and an outer side surface 36 (see, e.g., FIGS. 2, 3A-3D, 5A, and 5B). The front surface 32 is connected to the rear surface 34 by the outer side surface 36. The rear surface 34 is opposite the front surface 32 and defines a thickness $T_{30}$ (see, e.g., FIG. 3A) of the trim panel 30 extending along the outer side surface 36 that connects the front surface 32 to the rear surface 34.

Referring to FIGS. 2, 3A-3D, 5A, and 5B, the trim panel 30 may include one or more passages 38. The one or more passages 38 extend through the thickness $T_{30}$ of the trim panel 30. As seen at, for example, FIGS. 2, 5A, and 5B, the one or more passages 38 may include any desirable shape such as, for example, a substantially cylindrical shape that, as will be explained in the following disclosure, corresponds to the shape of the one or more lugs 26 for reception therein (see, e.g., FIGS. 3A-3B) for forming a first subassembly 10*a* of the assembly 10.

Referring to FIGS. 5A and 5B, the one or more passages 38 may be selectively arranged about and extend into the outer periphery of the trim panel 30 defined by the outer side surface 36. In some implementations, the one or more passages 38 may include, for example: (1) at least one passage 38*a* extending through the thickness $T_{30}$ of the trim panel 30 along the outer periphery of the first end segment 30*a* of the trim panel 30; (2) at least one passage 38*b* extending through the thickness $T_{30}$ of the trim panel 30 along the outer periphery of the first side segment 30*b* of the trim panel 30; (3) at least one passage 38*c* extending through the thickness $T_{30}$ of the trim panel 30 along the outer periphery of the second end segment 30*c* of the trim panel 30; (4) at least one passage 38*d* extending through the thickness $T_{30}$ of the trim panel 30 along the outer periphery of the second side segment 30*d* of the trim panel 30; (5) at least one passage 38*e* extending through the thickness $T_{30}$ of the trim panel 30 along the outer periphery of the first corner segment 30*e* of the trim panel 30; (6) at least one passage 38*f* extending through the thickness $T_{30}$ of the trim panel 30 along the outer periphery of the second corner segment 30*f* of the trim panel 30; (7) at least one passage 38*g* extending through the thickness $T_{30}$ of the trim panel 30 along the outer periphery of the third corner segment 30*g* of the trim panel 30; and (8) at least one passage 38*h* extending through the thickness $T_{30}$ of the trim panel 30 along the outer periphery of the fourth corner segment 30*h* of the trim panel 30.

In some implementations as seen at, for example, FIGS. 5A and 5B: (1) each of the segments 30*a*, 30*c* of the trim panel 30 includes, respectively, three passages 38*a*, 38*c*; (2) each of the segments 30*b*, 30*d* of the trim panel 30 includes, respectively, four passages 38*b*, 38*d*; and (3) each of the corner segments 30*e*, 30*f*, 30*g*, 30*h* of the trim panel 30 includes, respectively, one passage 38*e*, 38*f*, 38*g*, 38*h*. Accordingly, the trim panel 30 may include a total of eighteen passages 38 extending through the thickness $T_{30}$ of the trim panel 30 along the outer periphery of the trim panel 30.

Referring to FIG. 1, the assembly 10 further includes a container 40. The container 40 may be sized, shaped, or function as luggage, a suitcase, a briefcase, a handbag, a purse, a backpack, a rucksack, a lunchbox, or the like.

In some configurations, the container 40 may be, for example, luggage that includes a first shell half 42 joined by a fastener 44 (e.g., one or more of a zipper, living hinge member, or the like) to a second shell half 46. Each of the first shell half 42 and the second shell half 46 may be supported by a plurality of caster wheels 48. One or more of the first shell half 42 and the second shell half 46 may include a handle 49 (e.g., a fixed grip handle, a deployable telescoping handle, or the like).

Referring to FIGS. 2 and 3A-3D, in some implementations, one or both of the first shell half 42 and the second shell half 46 includes a support panel 50. With reference to FIG. 2, an exemplary implementation of the assembly 10 is described with the first shell half 42 including the support panel 50.

Referring to FIGS. 1 and 2, the first shell half 42 includes a body portion 52. Referring to FIGS. 2 and 3A-3D, the body portion 52 of the first shell half 42 includes a front surface 54, a rear surface 56 (see, e.g., FIG. 2), an inner side surface 58 (see, e.g., FIGS. 3A-3D), and an outer side surface 60. The front surface 54 is opposite the rear surface 56, and, the inner side surface 58 is opposite the outer side surface 60. As seen at FIGS. 3A-3D, the support panel 50 is connected to or extends from the inner side surface 58.

As seen at FIGS. 2 and 3A-3D, the support panel 50 includes a front surface 62. With reference to FIGS. 3A-3D the support panel 50 includes also includes a rear surface 64. Referring to FIG. 3A, the support panel 50 defines a support panel thickness Tso extending between the front surface 62 of the support panel 50 and the rear surface 64 of the support panel 50.

As will be described in the following disclosure, when the assembly 10 is at least partially assembled (see, e.g., a second subassembly 10*b* at FIG. 3C), a combination of thicknesses of the $T_{30}$ (see, e.g., FIG. 3A), Tso (see, e.g., FIG. 3A) of, respectively, the trim panel 30 and the support panel 50 is approximately equal to the length $L_{26}$ (see, e.g., FIG. 3A) of each lug 26 of the one or more lugs 26 such that the one or more lugs 26 peripherally receive and contain (in a substantially rectangular-shaped configuration) both of the trim panel 30 and the support panel 50 after insertion of the one or more lugs within the one or more passages 38 extending through the thickness $T_{30}$ of the trim panel 30 and one or more passages 68 extending through the thickness Tso of the support panel 50. In some instances, the thickness $T_{30}$ of the trim panel 30 is configured to be, for example, about 75% to about 85% (preferably about, e.g., 80%) of the length $L_{26}$ of each lug 26 of the one or more lugs 26, and, the thickness Tso of the support panel 50 is configured to be, for example, about 15% to about 25% (preferably about, e.g., 20%) of the length $L_{26}$ of each lug 26 of the one or more lugs 26.

Referring to FIG. 3A, the front surface 62 of the support panel 50 is recessed from the front surface 54 of the body portion 52 of the first shell half 42 at a depth $D_{66}$ for forming a cavity 66. With further reference to FIG. 3A, in some implementations, the depth $D_{66}$ is generally defined by: (1) the front surface 62 of the support panel 50; and (2) a portion 58' of the inner side surface 58 of the body portion 52 of the first shell half 42 that extends from the front surface 62 of the support panel 50.

As will be described in the following disclosure, when the assembly 10 is at least partially assembled (see, e.g., a second subassembly 10*b* at FIG. 3C), the combination of thicknesses of the T12*a* (see, e.g., FIG. 3A), $T_{30}$ (see, e.g., FIG. 3A) of the frame 12 and the trim panel 30 is approximately equal to the depth $D_{66}$ of the cavity 66 for peripheral reception and containment of both of the frame 12 and the trim panel 30 (i.e., the first subassembly 10*a*) within the cavity 66 of the first shell half 42 of the container 40. In some instances, the thickness T12*a* of the frame 12 is configured to be, for example, about 15% to about 50% (preferably about, e.g., 40%) of the depth $D_{66}$ of the cavity 66 of the first shell half 42 of the container 40, and, the thickness $T_{30}$ of the trim panel 30 is configured to be, for example, about 30% to about 65% (preferably about, e.g., 60%) of the depth $D_{66}$ of the cavity 66 of the first shell half 42 of the container 40.

The cavity 66 may include any desirable shape (e.g., a rectangle, a square, a circle, a triangle, or the like). With reference to FIG. 2, in some examples, the cavity 66 may include a substantially rectangular shape.

In some implementations, as seen at FIG. 2, the rectangular shape of the cavity 66 is defined by the portion 58' of the inner side surface 58 of the body portion 52 of the first shell half 42 having: a first end segment 58*a*; a first side segment 58*b*; a second end segment 58*c*; and a second side segment 58*d*. The first end segment 58*a* that is opposite a second end segment 58*c*. The first side segment 58*b* is opposite a second side segment 58*d*. Furthermore, in some configurations, the portion 58' of the inner side surface 58 of the body portion 52 of the first shell half 42 may include: a first corner segment 58*e*; a second corner segment 58*f*; a third corner segment 58*g*; and a fourth corner segment 58*h*. Each of the corner segments 58*e*-58*h* may include, for example, an arcuate shape. The first corner segment 58*e* connects the first end segment 58*a* to the first side segment 58*b*. The second corner segment 58*f* connects the first side segment 58*b* to the second end segment 58*c*. The third corner segment 58*g* connects the second end segment 58*c* to the second side segment 58*d*. The fourth corner segment 58*h* connects the second side segment 58*d* to the first end segment 58*a*.

Referring to FIGS. 2 and 3A-3D, the support panel 50 may include the one or more passages 68. As seen at, for example, FIG. 3A, the one or more passages 68 extend through the thickness $T_{50}$ of the support panel 50. The one or more passages 68 may include any desirable shape such as, for example, a substantially cylindrical shape that, as will be explained in the following disclosure, corresponds to the shape of the one or more lugs 26 for reception therein.

The one or more passages 68 may be selectively arranged about and extend into the outer periphery of the support panel 50 approximately at a region where the support panel 50 extends from the inner side surface 58 of the body portion 52 of the first shell half 42. In some implementations, the one or more passages 68 may include, for example: (1) at least one passage 68 extending through the thickness $T_{50}$ of the support panel 50 along the first end segment 58*a* of the portion 58' of the inner side surface 58 of the body portion 52 of the first shell half 42; (2) at least one passage 68 extending through the thickness $T_{50}$ of the support panel 50 along the first side segment 58*b* of the portion 58' of the inner side surface 58 of the body portion 52 of the first shell half 42; (3) at least one passage 68 extending through the thickness $T_{50}$ of the support panel 50 along the second end segment 58*c* of the portion 58' of the inner side surface 58 of the body portion 52 of the first shell half 42; (4) at least one passage 68 extending through the thickness $T_{50}$ of the support panel 50 along the second side segment 58*d* of the portion 58' of the inner side surface 58 of the body portion 52 of the first shell half 42; (5) at least one passage 68 extending through the thickness Tso of the support panel 50 along the first corner segment 58*e* of the portion 58' of the inner side surface 58 of the body portion 52 of the first shell half 42; (6) at least one passage 68 extending through the thickness $T_{50}$ of the support panel 50 along the second corner segment 58*f* of the portion 58' of the inner side surface 58 of the body portion 52 of the first shell half 42; (7) at least one passage 68 extending through the thickness $T_{50}$ of the support panel 50 along the third corner segment 58*g* of the portion 58' of the inner side surface 58 of the body portion 52 of the first shell half 42; and (8) at least one passage 68 extending through the thickness $T_{50}$ of the support panel 50 along the fourth corner segment 58*h* of the portion 58' of the inner side surface 58 of the body portion 52 of the first shell half 42.

In some implementations as seen at, for example, FIG. 2: (1) each of the segments 58*a*, 58*c* of the support panel 50 includes, respectively, three passages 68 (2) each of the segments 58*b*, 58*d* of the support panel 50 includes, respectively, four passages 68; and (3) each of the corner segments 58*e*, 58*f*, 58*g*, 58*h* of the support panel 50 includes, respectively, one passage 68. Accordingly, the support panel 50 may include a total of eighteen passages 68 extending through the thickness Ts of the support panel 50 approximately at the region where the support panel 50 extends from the portion 58' of the inner side surface 58 of the body portion 52 of the first shell half 42.

Referring to FIGS. 2 and 3A-3D, the assembly 10 further includes one or more optional fasteners 70. The one or more optional fasteners 70 may be defined by, for example, one or more threaded fasteners (e.g. one or more screws).

Referring to FIG. 3A, the one or more optional threaded fasteners 70 may include a head portion 72 and a threaded stem portion 74. The threaded stem portion 74 may include a proximal end 76 ending from the head portion 72 and a distal end 78. The threaded stem portion 74 may be defined by a length $L_{74}$ extending between the proximal end 76 and the distal end 78.

With further reference to FIG. 3A, the one or more lugs 26 extending from one or both of the first rear surface 16 of the frame 12 and the second inner side surface 24 of the frame 12 each include a fastener-receiving portion 80. The fastener-receiving portion 80 is defined by a length $L_{80}$. The fastener-receiving portion 80 is further defined by a threaded surface 82. The threaded surface 82 further defines a threaded cavity 84.

The threaded cavity 84 is configured to receive the threaded stem portion 74 of each optional fastener 70 of the one or more fasteners 70. Furthermore, the length $L_{74}$ of the each optional fastener 70 of the one or more optional fasteners 70 is approximately equal to the length $L_{80}$ of the threaded cavity 84 of the fastener-receiving portion 80 of the one or more lugs 26.

With reference to FIG. 2, in some configurations, the one or more fasteners 70 include, for example, eighteen fasteners 70; while eighteen fasteners 70 are shown, any desirable amount of fasteners 70 may be incorporated into the assembly 10 such, as for example, one or more fasteners 70. The eighteen fasteners 70 may be distributed by associating: (1) three fasteners 70 with the fastener-receiving portions 80 of the three lugs 26*a* of the first end segment 12*a* of the frame 12; (2) four fasteners 70 with the fastener-receiving portions 80 of the four lugs 26*b* of the first side segment 12*b* of the frame 12 (3) three fasteners 70 with the fastener-receiving portions 80 of the three lugs 26*c* of the second end segment 12*c* of the frame 12; (4) four fasteners 70 with the fastener-receiving portions 80 of the four lugs 26*d* of the second side segment 12*d* of the frame 12; (5) one fastener 70 with the fastener-receiving portion 80 of the one lug 26*e* of the first corner segment 12*e* of the frame 12; (6) one fastener 70 with the fastener-receiving portion 80 of the one lug 26*f* of the second corner segment 12*f* of the frame 12; (7) one fastener 70 with the fastener-receiving portion 80 of the one lug 26*g* of the third corner segment 12*g* of the frame 12; and (8) one fastener 70 with the fastener-receiving portion 80 of the one lug 26*h* of the fourth corner segment 12*h* of the frame 12.

With reference to FIGS. 2 and 3A-3D, the assembly 10 may be assembled according to the following exemplary steps, which may occur, for example: (1) sequentially; (2) in any order; or (3) simultaneously. Firstly, as seen at FIGS. 2 and 3A, the one or more lugs 26 of the frame 12 are axially aligned with the one or more passages 38 extending through the thickness $T_{30}$ of the trim panel 30 along one or more respective axes $A_{10a}$-$A_{10a}$ whereby, for example: (1) the three lugs 26*a* of the first end segment 12*a* of the frame 12 are axially aligned with the three passages 38*a* extending through the thickness $T_{30}$ of the trim panel 30 along the outer periphery of the first end segment 30*a* of the trim panel 30; (2) the four lugs 26*b* of the first side segment 12*b* of the frame 12 are axially aligned with the four passages 38*bs* extending through the thickness $T_{30}$ of the trim panel 30 along the outer periphery of the first side segment 30*b* of the trim panel 30; (3) the three lugs 26*c* of the second end segment 12*c* of the frame 12 are axially aligned with the three passages 38*c* extending through the thickness $T_{30}$ of the trim panel 30 along the outer periphery of the second end segment 30*c* of the trim panel 30; (4) the four lugs 26*d* of the second side segment 12*d* of the frame 12 are axially aligned with the four passages 38*d* extending through the thickness $T_{30}$ of the trim panel 30 along the outer periphery of the second side segment 30*d* of the trim panel 30; (5) the one lug 26*e* of the first corner segment 12*e* of the frame 12 are axially aligned with the one passage 38*e* extending through the thickness $T_{30}$ of the trim panel 30 along the outer periphery of the first corner segment 30*e* of the trim panel 30; (6) the one lug 26*f* of the second corner segment 12*f* of the frame 12 are axially aligned with the one passage 38*f* extending through the thickness $T_{30}$ of the trim panel 30 along the outer periphery of the second corner segment 30*f* of the trim panel 30; (7) the one lug 26*g* of the third corner segment 12*g* of the frame 12 are axially aligned with the one passage 38*g* extending through the thickness $T_{30}$ of the trim panel 30 along the outer periphery of the third corner segment 30*g* of the trim panel 30; and (8) the one lug 26*h* of the fourth corner segment 12*h* of the frame 12 are axially aligned with the one passage 38*h* extending through the thickness $T_{30}$ of the trim panel 30 along the outer periphery of the fourth corner segment 30*h* of the trim panel 30.

Referring to FIGS. 3A-3B, after axial alignment of the one or more lugs 26 of the frame 12 with the one or more passages 38 of the trim panel 30 along the one or more respective axes $A_{10a}$-$A_{10a}$, the one or more lugs 26 of the frame 12 are arranged within the one or more passages 38 of the trim panel 30. As seen at FIG. 3B, upon fully inserting the one or more lugs 26 of the frame 12 within the one or more passages 38 of the trim panel 30, the first rear surface 16 of the frame 12 is disposed opposite or adjacent the front surface 32 of the trim panel 30 for forming a first subassembly 10*a* of the assembly 10. The first subassembly 10*a* includes the frame 12 connected to the trim panel 30. Furthermore, upon fully inserting the one or more lugs 26 of the frame 12 within the one or more passages 38 of the trim panel 30, a portion of the length $L_{26}$ of the one or more lugs 26 is arranged beyond the rear surface 34 of the trim panel 30 to a distance approximate equal to the thickness $T_{50}$ of the support panel 50.

With reference to FIG. 3B the first subassembly 10*a* is arranged proximate the first shell half 42 of the container 40. The one or more lugs 26 of the frame 12 of the first subassembly 10*a* are axially aligned (which may occur, for example: (1) sequentially; (2) in any order; or (3) simultaneously) with the one or more passages 68 extending through the thickness $T_{50}$ of the support panel 50 along one or more axes $A_{10b}$-$A_{10b}$ whereby, for example: (1) the three lugs 26*a* of the first end segment 12*a* of the frame 12 are axially aligned with the three passages 68 extending through the thickness Tso of the support panel 50 along the first end segment 58*a* of the portion 58' of the inner side surface 58 of the body portion 52 of the first shell half 42; (2) the four lugs 26*b* of the first side segment 12*b* of the frame 12 are axially aligned with the four passages 68 extending through the thickness $T_{50}$ of the support panel 50 along the first side segment 58*b* of the portion 58' of the inner side surface 58 of the body portion 52 of the first shell half 42; (3) the three lugs 26*c* of the second end segment 12*c* of the frame 12 are axially aligned with the three passages 68 extending through the thickness $T_{50}$ of the support panel 50 along the second end segment 58*c* of the portion 58' of the inner side surface 58 of the body portion 52 of the first shell half 42; (4) the four lugs 26*d* of the second side segment 12*d* of the frame 12 are axially aligned with the four passages 68 extending through the thickness $T_{50}$ of the support panel 50 along the second side segment 58*d* of the portion 58' of the inner side surface 58 of the body portion 52 of the first shell half 42; (5) the one lug 26*e* of the first corner segment 12*e* of the frame 12 are axially aligned with the one passage 68 extending through the thickness Tso of the support panel 50 along the first corner segment 58*e* of the portion 58' of the inner side surface 58 of the body portion 52 of the first shell half 42; (6) the one lug 26*f* of the second corner segment 12*f* of the frame 12 are axially aligned with the one passage 68 extending through the thickness Tso of the support panel 50 along the second corner segment 58*f* of the portion 58' of the inner side surface 58 of the body portion 52 of the first shell half 42; (7) the one lug 26*g* of the third corner segment 12*g* of the frame 12 are axially aligned with the one passage 68 extending through the thickness Tso of the support panel 50 along the third corner segment 58*g* of the portion 58' of the inner side surface 58 of the body portion 52 of the first shell half 42; and (8) the one lug 26*h* of the fourth corner segment 12*h* of the frame 12 are axially aligned with the one passage 68 extending through the thickness Tso of the support panel 50 along the fourth corner segment 58*h* of the portion 58' of the inner side surface 58 of the body portion 52 of the first shell half 42.

Figure 3D:
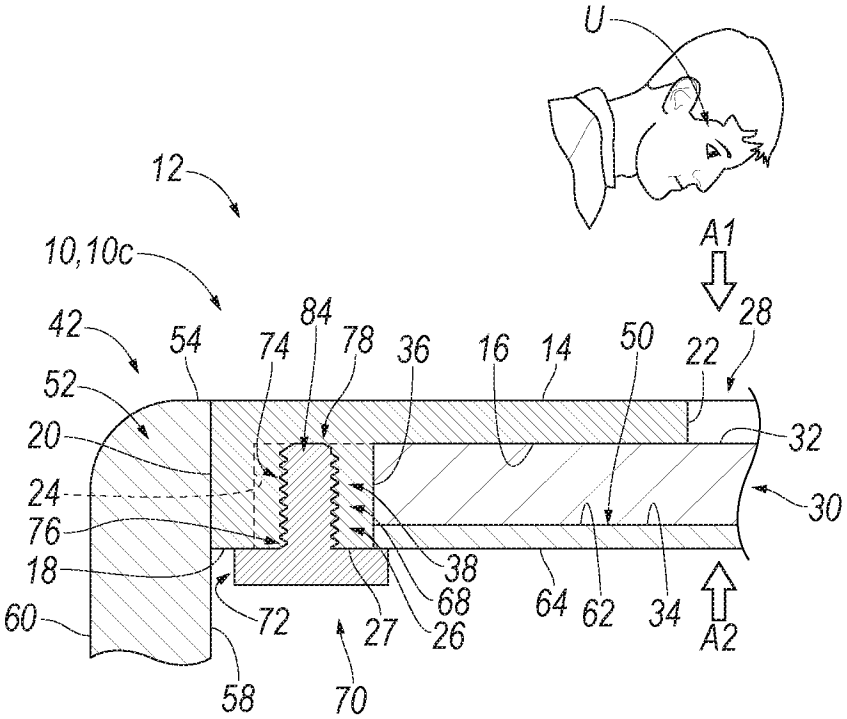
FIG. 3D is a cross-sectional view of the assembly according to FIG. 3C in an even further assembled state.
Figure 3C:
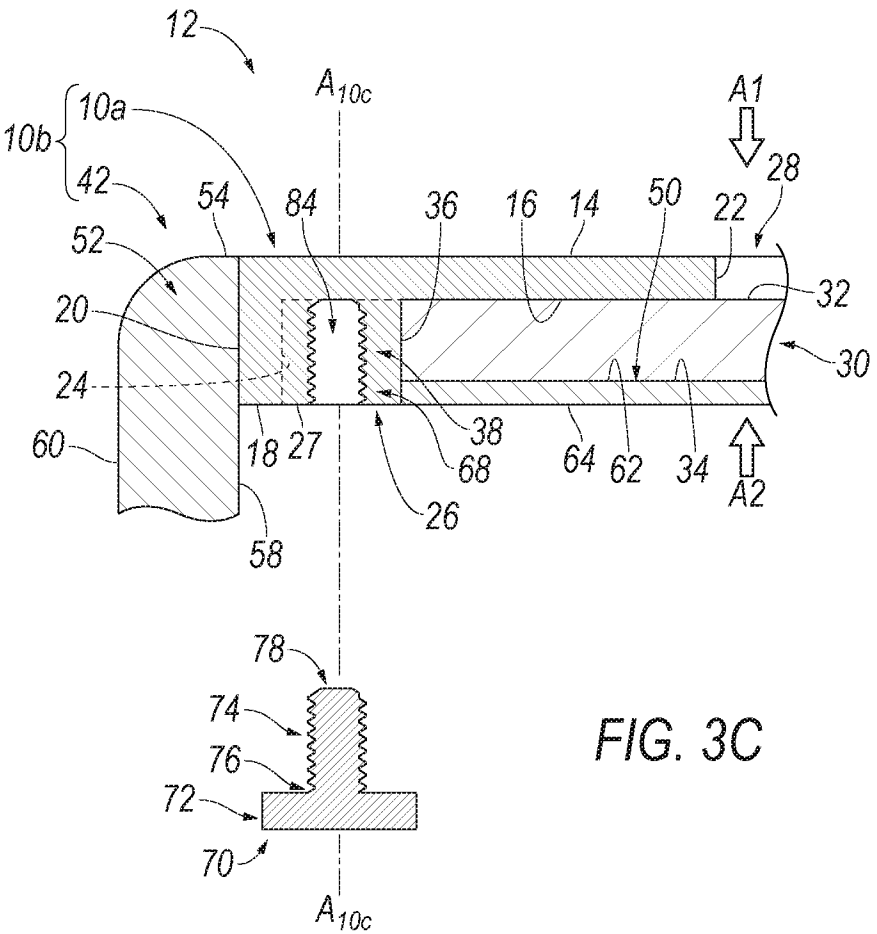
FIG. 3C is a cross-sectional view of the assembly according to FIG. 3B in a further partially assembled state.

Referring to FIGS. 3B-3C, the portion of the length $L_{26}$ of the one or more lugs 26 that is arranged beyond the rear surface 34 of the trim panel 30 to the distance approximate equal to the thickness $T_{50}$ of the support panel 50 are then inserted within the one or more passages 68 of the support panel 50 such that the rear surface 34 of the trim panel 30 is disposed opposite or adjacent the front surface 62 of the support panel 50 for forming a second subassembly 10*b* of the assembly 10. As seen at FIG. 3C, the second subassembly 10*b* includes the first subassembly 10*a* (i.e., the frame 12 connected to the trim panel 30) connected to the first shell half 42 of the container 40.

Upon forming the second assembly 10*b* as described above, the first assembly 10*a* may be said to be either "removably-attached" to the first shell half 42 of the container 40, or, alternatively, "selectively-secured" to the first shell half 42 of the container 40. The act of "removably-attaching" the first assembly 10*a* to the first shell half 42 of the container 40 for forming the second subassembly 10*b* means that the first assembly 10*a* may be freely disconnected from the first shell half 42 of the container 40 at any time (i.e., the first assembly 10*a* is connected to the first shell half 42 of the container 40 in an "unlocked" manner). Conversely, the act of "selectively securing" the first assembly 10*a* to the first shell half 42 of the container 40 for forming the second subassembly 10*b* means that the first assembly 10*a* may not be freely removed from the first shell half 42 of the container 40 at any time (i.e., the first assembly 10*a* is secured to the first shell half 42 of the container 40 in a "locked" manner whereby user intervention may result in selective "unlocking" of the first assembly 10*a* from the first shell half 42 of the container 40 prior to selectively removing the first assembly 10*a* from the first shell half 42 of the container 40).

In some implementations as will be described below at FIGS. 3C and 3D, the one or more optional fasteners 70 may be utilized for selectively-securing the first assembly 10*a* to the first shell half 42 of the container 40 for forming the second subassembly 10*b*. In other implementations, the first subassembly 10*a* may be selectively-secured to the first shell half 42 of the container 40 for forming the second subassembly 10*b* in FIG. 3C without, for example, the one or more optional fasteners 70. In some instances, the selective-securement of the first subassembly 10*a* to the first shell half 42 of the container 40, which may define the assembly 10, may arise from a friction-fit connection of the one or more lugs 26 of the frame 12 within one or both of the one or more passages 38 of the trim panel 30 and the one or more passages 68 of the support panel 50 (i.e., rather than "unlocking" the first subassembly 10*a* from the first shell half 42 of the container 40 with the one or more optional fasteners 70, a user U (see, e.g., FIG. 3D) may result in selective application of a force to the one or more lugs 26 in order to dislodge the friction-fit connection of the one or more lugs 26 from one or both of the one or more passages 38 of the trim panel 30 and the one or more passages 68 of the support panel 50).

With reference now to FIGS. 3C and 3D, with the first subassembly 10*a* being connected to the first shell half 42 of the container 40 for forming the second subassembly 10*b*, the one or more optional fasteners 70 may be utilized for selective-securing the first subassembly 10*a* to the first shell half 42 of the container 40 for forming a third subassembly 10*c* (see, e.g., FIG. 3D) which may be alternatively define the assembly 10 (if, e.g., the second shell half 46 is connected to the first shell half 42 by, for example, the fastener 44, which may be, for example, a zipper, living hinge member, or the like). As seen at FIG. 3C, the third subassembly 10*c* may be formed by axially aligning (which may occur, for example: (1) sequentially; (2) in any order; or (3) simultaneously) the threaded stem portion 74 of each fastener 70 of the one or more fasteners 70 and then subsequently being disposed within (as seen at, e.g., FIG. 3D) the one or more threaded cavities 84 of the one or more fastener-receiving portions 80 of the one or more lugs 26 along one or more axes $A_{10c}$-$A_{10c}$ whereby, for example: (1) the threaded stem portions 74 of three fasteners 70 are axially aligned with and then disposed within the threaded cavities 84 of three lugs 26*a* of the first end segment 12*a* of the frame 12; (2) the threaded stem portions 74 of four fasteners 70 are axially aligned with and then disposed within the threaded cavities 84 of four lugs 26*b* of the first side segment 12*b* of the frame 12; (3) the threaded stem portions 74 of three fasteners 70 are axially aligned with and then disposed within the threaded cavities 84 of three lugs 26*c* of the second end segment 12*c* of the frame 12; (4) the threaded stem portions 74 of four fasteners 70 are axially aligned with and then disposed within the threaded cavities 84 of four lugs 26*d* of the second side segment 12*d* of the frame 12; (5) the threaded stem portions 74 of one fasteners 70 are axially aligned with and then disposed within the threaded cavity 84 of one lug 26*e* of the first corner segment 12*e* of the frame 12; (6) the threaded stem portions 74 of one fasteners 70 are axially aligned with and then disposed within the threaded cavity 84 of one lug 26*f* of the second corner segment 12*f* of the frame 12; (7) the threaded stem portions 74 of one fasteners 70 are axially aligned with and then disposed within the threaded cavity 84 of one lug 26*g* of the third corner segment 12*g* of the frame 12; and (8) the threaded stem portions 74 of one fasteners 70 are axially aligned with and then disposed within the threaded cavity 84 of one lug 26*h* of the fourth corner segment 12*h* of the frame 12.

As seen at FIG. 3D, upon fully axially disposing the one or more optional fasteners 70 within the one or more threaded cavities 84 of the one or more fastener-receiving portions 80 of the one or more lugs 26, the head portion 72 of the one or more optional fasteners 70 is disposed opposite or adjacent the rear surface 64 of the support panel 50 for selectively-securing the frame 12 of the first subassembly 10*a* to the first shell half 42 of the container 40. As a result of selectively-securing the frame 12 to the first shell half 42 of the container 40, the trim panel 30 is selectively-secured: (1) axially (according to, e.g., the axis $A_{10c}$-$A_{10c}$) between the first rear surface 16 of the frame 12 and the front surface 62 of the support panel 50; and (2) peripherally, in a substantially rectangular arrangement, by the one or more lugs 26.

With continued reference to FIG. 3D, the front surface 62 of the support panel 50 is disposed opposite or adjacent the rear surface 34 of the trim panel 30. Further, the first rear surface 16 of the frame 12 is disposed opposite or adjacent a first portion of the front surface 32 of the trim panel 30. Furthermore, a second portion of the front surface 32 of the trim panel 30 is exposed to surrounding atmosphere by the frame opening 28 defined by first inner side surface 22 of the frame 12.

The first portion of the front surface 32 of the trim panel 30 may include an outer periphery of the front surface 32 of the trim panel 30 that extends from the outer side surface 36 of the trim panel 30. The second portion of the front surface 32 of the trim panel 30 may include a remainder of the front surface 32 that is peripherally bounded by the first portion of the front surface 32 of the trim panel 30.

With reference to FIGS. 1, 2 and 5A, the front surface 32 of the trim panel 30 may optionally include a first design having aesthetically-pleasing artwork A1, indicia(s), symbol(s), picture(s), or the like (see also, e.g., arrow A1 in FIGS. 3A-3D). In some examples, the first design having aesthetically-pleasing artwork A1, indicia(s), symbol(s), picture(s), or the like may extend across all of the front surface 32 of the trim panel 30. With reference to FIG. 5A, in other examples, the first design having aesthetically-pleasing artwork A1, indicia(s), symbol(s), picture(s), or the like may extend across only the second portion of the front surface 32 of the trim panel 30 (that would be exposed to surrounding atmosphere by the frame opening 28 of the frame 12).

As seen at FIGS. 2 and 3A, in the process arranging or preparing the components for forming the first subassembly 10*a* of the assembly 10, the trim panel 30 may be prepared in a manner such that the front surface 32 of the trim panel 30 is arranged opposite the first rear surface 16 of the frame 12. Accordingly, as the second subassembly 10*b* or assembly 10 is assembled as described above, the first design having aesthetically-pleasing artwork A1, indicia(s), symbol(s), picture(s), or the like (that is included upon the front surface 32 of the trim panel 30) is exposed to surrounding atmosphere by the frame opening 28 of the frame 12, and, as a result, viewable by anyone in the surrounding atmosphere such as, for example, the user U of the assembly 10.

With reference to FIG. 5B, the rear surface 34 of the trim panel 30 may optionally include a second design having aesthetically-pleasing artwork A2, indicia(s), symbol(s), picture(s), or the like (see also, e.g., arrow A2 in FIGS. 3A-3D) that may be different from the first design having aesthetically-pleasing artwork A1, indicia(s), symbol(s), picture(s), or the like. In some examples, the second design having aesthetically-pleasing artwork A2, indicia(s), symbol(s), picture(s), or the like may extend across all of the rear surface 34 of the trim panel 30. With reference to FIG. 5B, in other examples, the second design having aesthetically-pleasing artwork A2, indicia(s), symbol(s), picture(s), or the like may extend across only a second portion of the rear surface 34 of the trim panel 30 (that would be exposed to surrounding atmosphere by the frame opening 28 of the frame 12) in a substantially similar manner as that of the second portion of the front surface 32 of the trim panel 30 as described above.

Accordingly, if, for example, the user U prefers to display the second design having aesthetically-pleasing artwork A2, indicia(s), symbol(s), picture(s), or the like (rather than the first design having aesthetically-pleasing artwork A1, indicia(s), symbol(s), picture(s), or the like), with reference to FIG. 3A, the user U would merely 'flip' the trim panel 30 such that the rear surface 34 of the trim panel 30 is arranged opposite the first rear surface 16 of the frame 12. Accordingly, as the second subassembly 10*d* or assembly 10 is assembled in a substantially similar manner as described above (but with the trim panel 30 'flipped' as described above), the second design having aesthetically-pleasing artwork A2, indicia(s), symbol(s), picture(s), or the like (that is included upon the rear surface 34 of the trim panel 30) is exposed to surrounding atmosphere by the frame opening 28 of the frame 12, and, as a result, viewable by anyone in the surrounding atmosphere such as, for example, the user U of the assembly 10.

With reference to FIGS. 4 and 5A-5B, the exemplary arrangement of the eighteen: (1) lugs 26 extending from one or more of the first rear surface 16, the second rear surface 18, and the second inner side surface 24 of the frame 12; and (2) passages 38 extending through the thickness $T_{30}$ of the trim panel 30 along the outer periphery of the trim panel 30 results in the assembly 10 (see, e.g., FIG. 3B) having a first axially-keyed configuration. Furthermore, the exemplary arrangement of the eighteen: (1) lugs 26 extending from one or more of the first rear surface 16, the second rear surface 18, and the second inner side surface 24 of the frame 12; (2) passages 38 extending through the thickness $T_{30}$ of the trim panel 30 along the outer periphery of the trim panel 30; and (3) passages 68 extending through the thickness $T_{50}$ of the support panel 50 approximately at the region where the support panel 50 extends from the portion 58' of the inner side surface 58 of the body portion 52 of the first shell half 42 results in the assembly 10 (see, e.g., FIG. 3C) having a second axially-keyed configuration that is substantially similar to the first axially-keyed configuration. While eighteen lugs 26, passages 38, and fasteners 70 are shown, any desirable amount of lugs 26, passages 38, and fasteners 70 may be incorporated into the assembly 10 such, as for example, one or more lugs 26, passages 38, and fasteners 70.

Figure 6B:
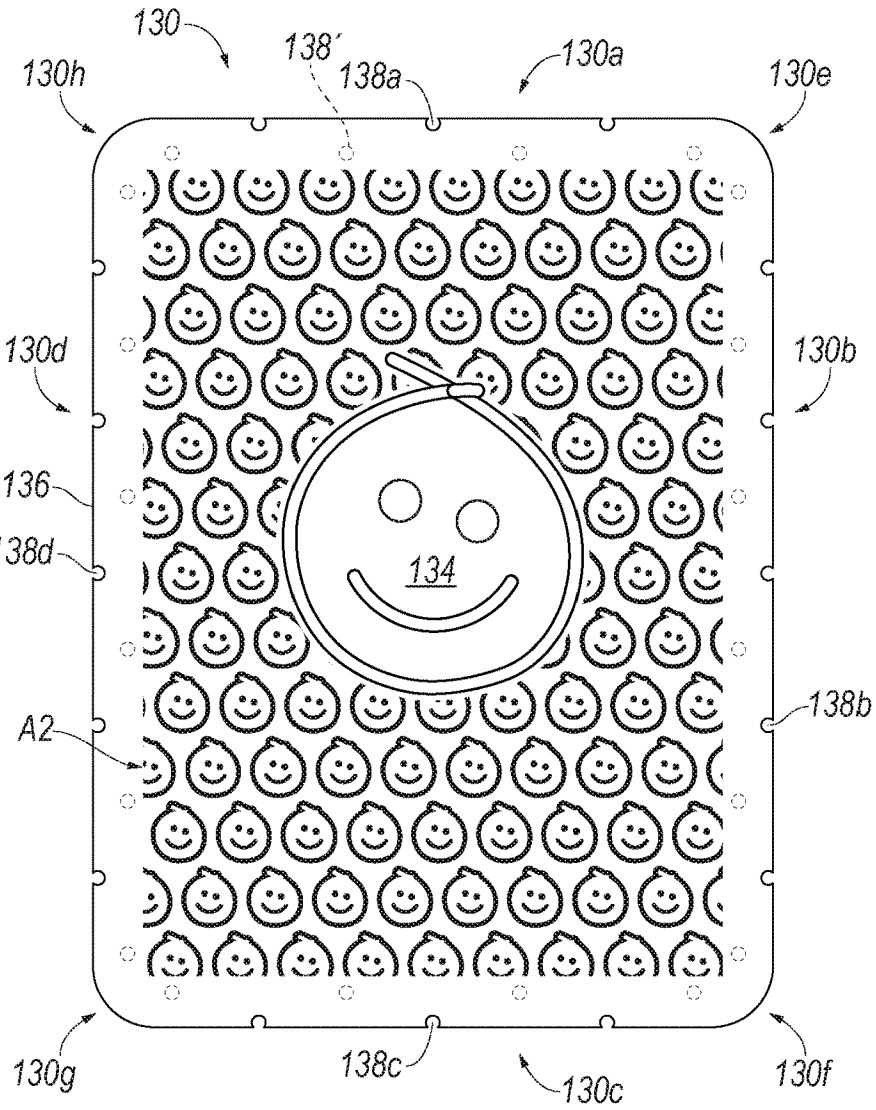
FIG. 6B is a rear view of the trim panel of FIG. 6A.
Figure 6A:
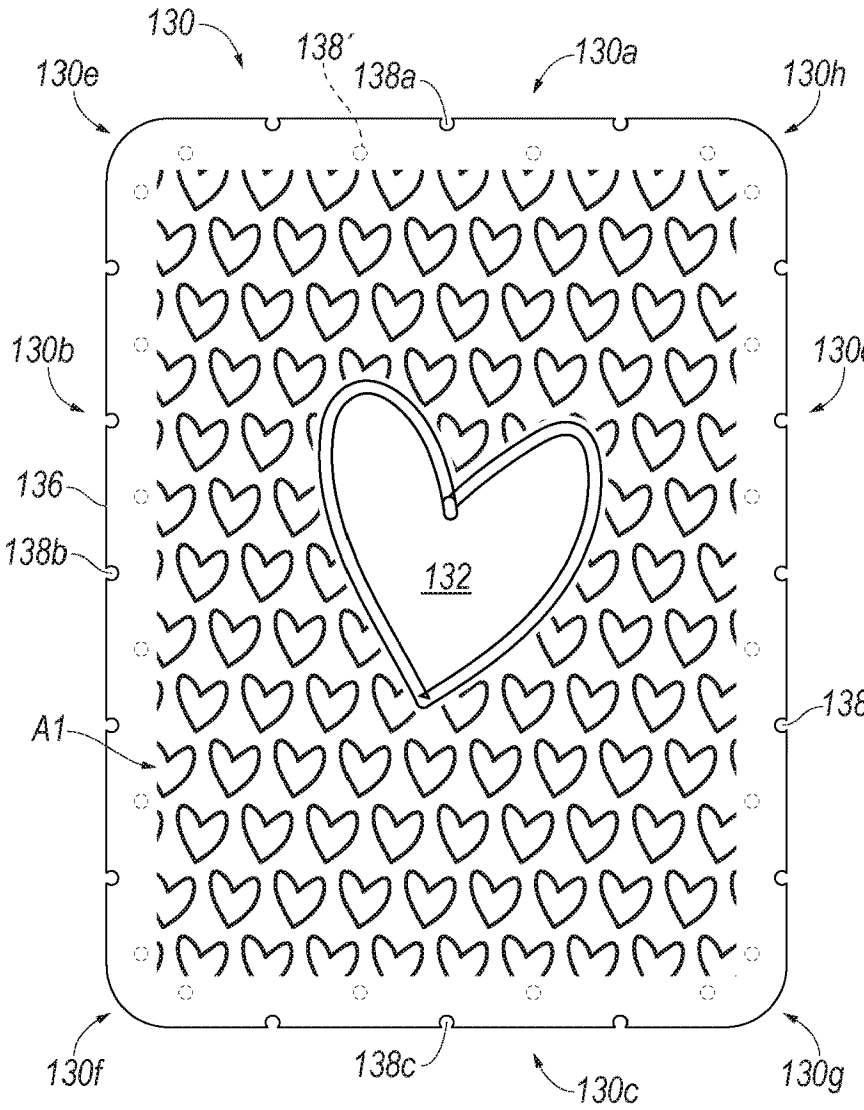
FIG. 6A is a front view of a trim panel having another arrangement of passages that are configured to receive another corresponding arrangement of lugs extending from a frame.
Figure 7B:
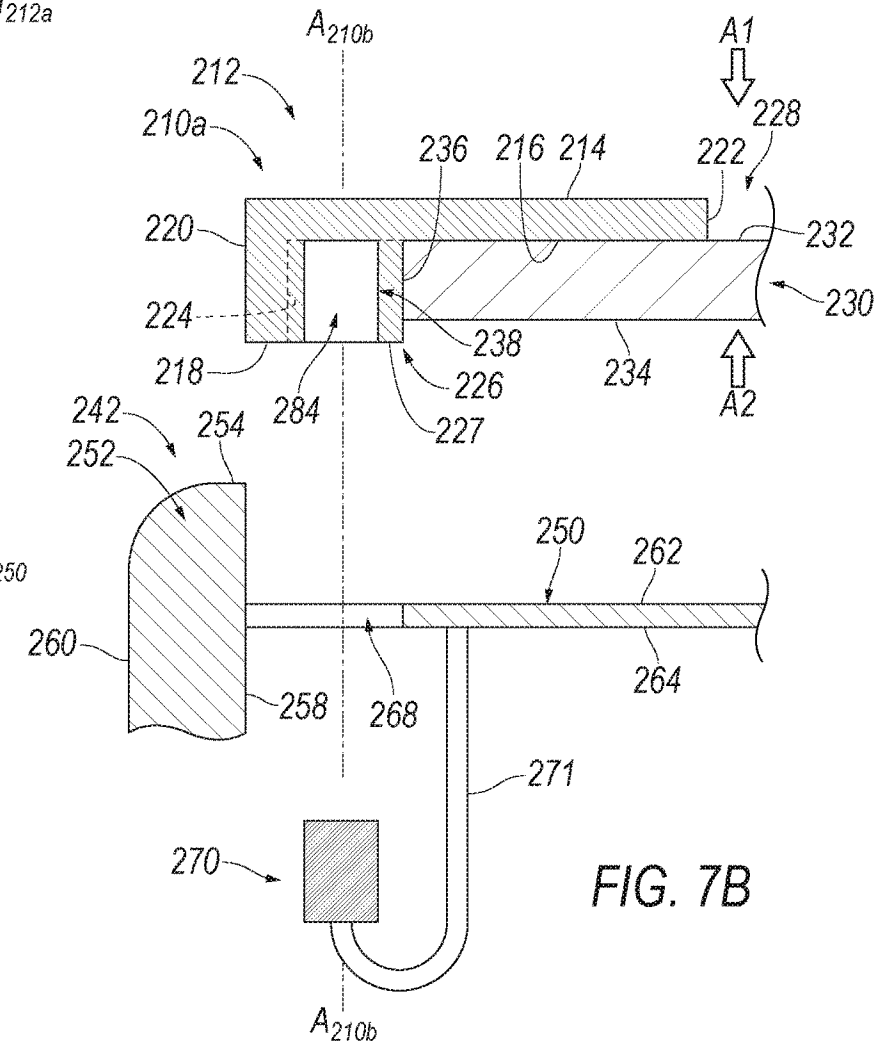
FIG. 7B is a cross-sectional view of the assembly according to FIG. 7A in a partially assembled state.
Figure 7A:
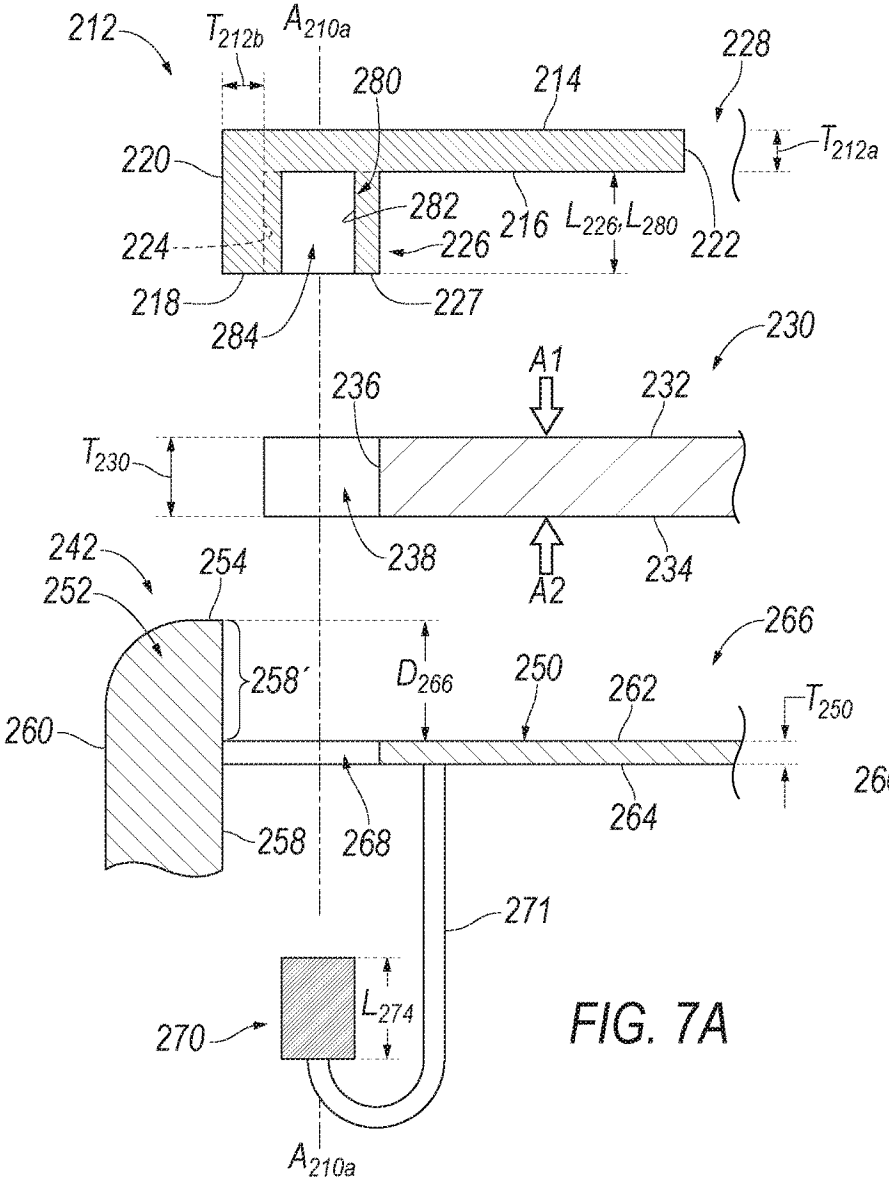
FIG. 7A is a cross-sectional view of an alternative assembly.
Figure 7D:
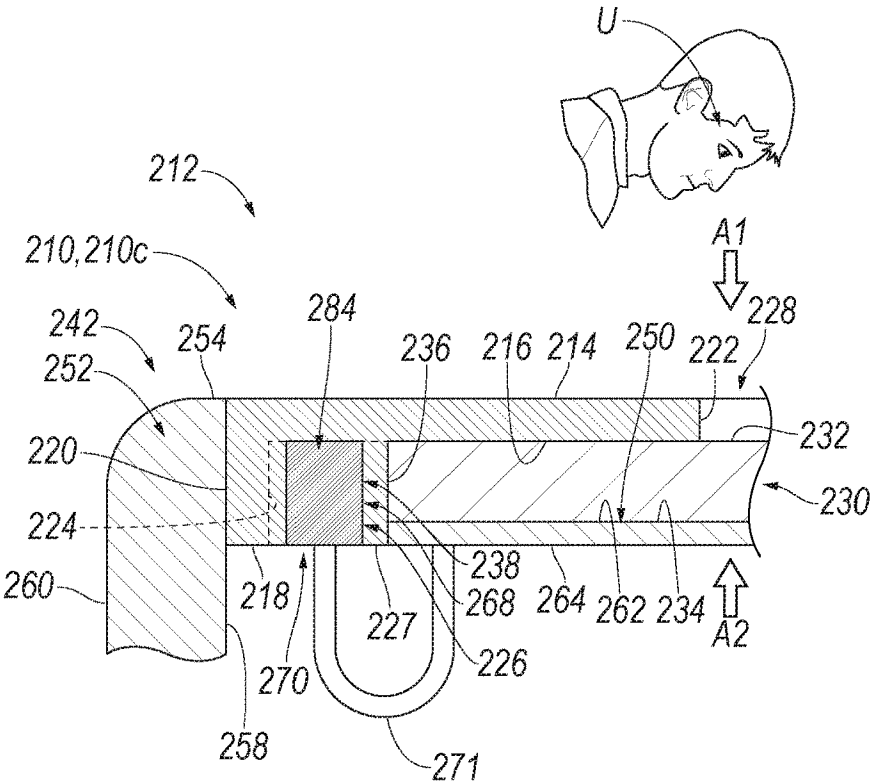
FIG. 7D is a cross-sectional view of the assembly according to FIG. 7C in an even further assembled state.
Figure 7C:
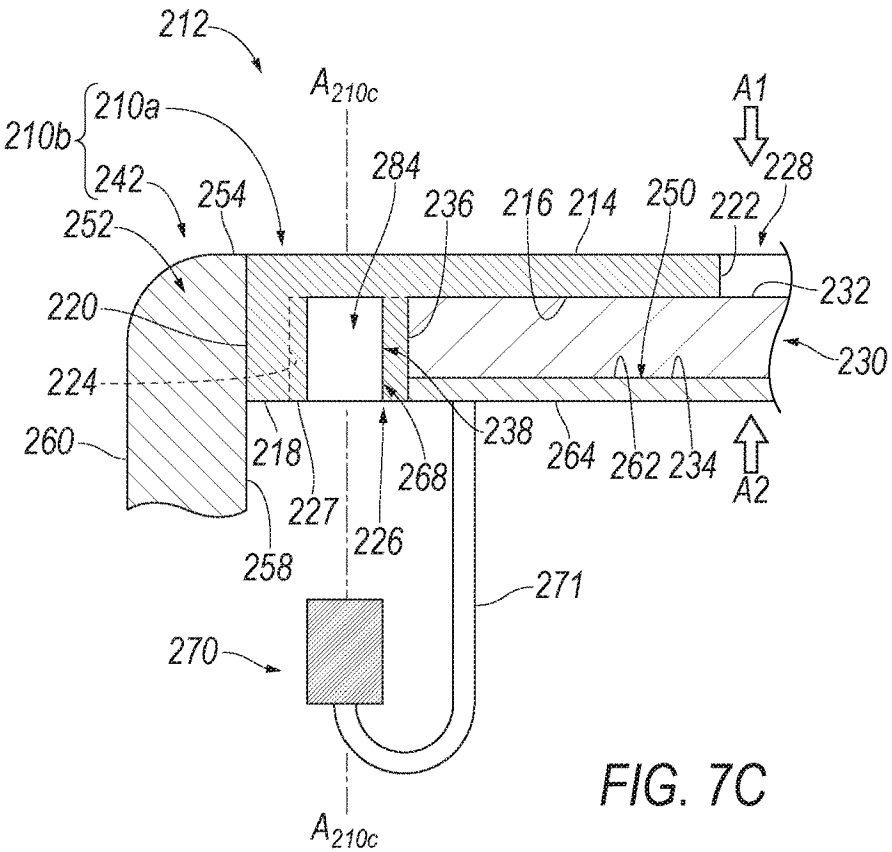
FIG. 7C is a cross-sectional view of the assembly according to FIG. 7B in a further partially assembled state.
Figure 8B:
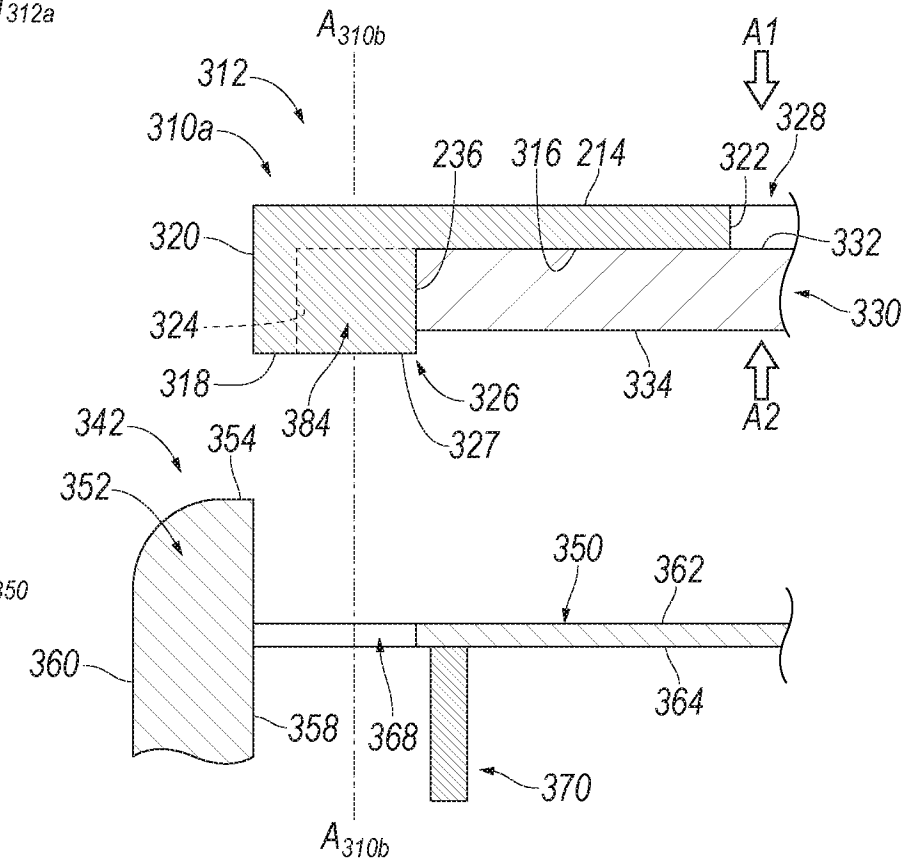
FIG. 8B is a cross-sectional view of the assembly according to FIG. 8A in a partially assembled state.
Figure 8A:
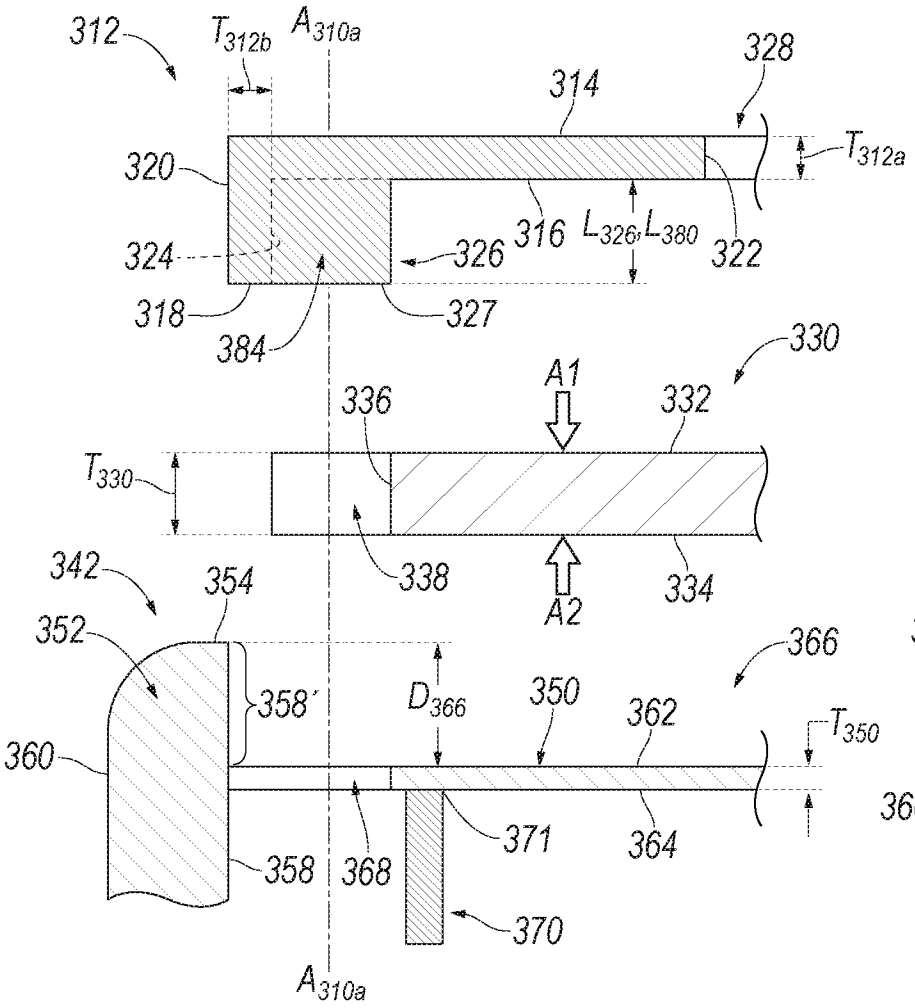
FIG. 8A is a cross-sectional view of an alternative assembly.
Figure 8D:
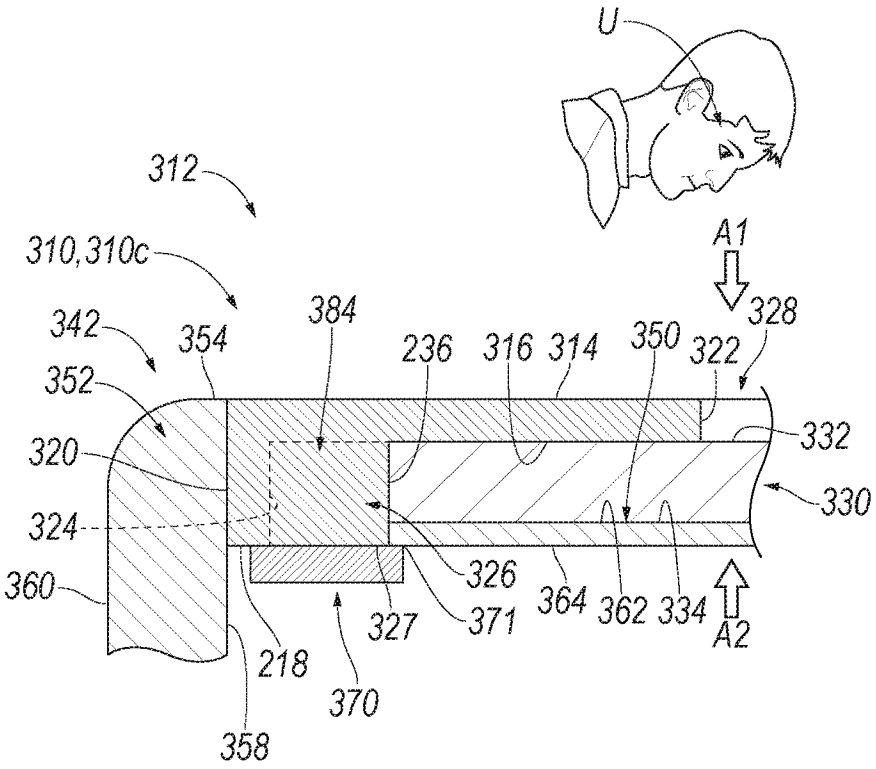
FIG. 8D is a cross-sectional view of the assembly according to FIG. 8C in an even further assembled state.
Figure 8C:
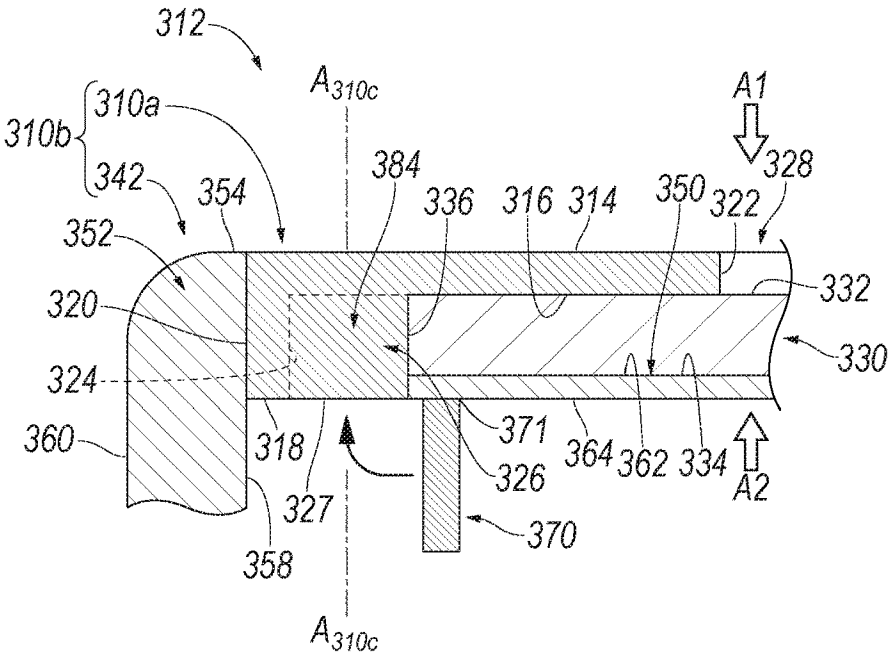
FIG. 8C is a cross-sectional view of the assembly according to FIG. 8B in a further partially assembled state.

Referring to FIGS. 6A and 6B, an exemplary trim panel 130 having a front surface 132, a rear surface 134 and an outer side surface 136 is shown. The front surface 132 includes a first design having aesthetically-pleasing artwork A1, indicia(s), symbol(s), picture(s), or the like. The rear surface 134 includes a second design having aesthetically-pleasing artwork A2, indicia(s), symbol(s), picture(s), or the like. Furthermore, one or more passages 138 may be selectively arranged about and extend into the outer periphery of the trim panel 130 defined by the outer side surface 136.

In some implementations as seen at, for example, FIGS. 6A and 6B: (1) each of the segments 130*a*, 130*c* of the trim panel 130 includes, respectively, three passages 138*a*, 138*c*; (2) each of the segments 130*b*, 130*d* of the trim panel 30 includes, respectively, five passages 138*b*, 138*d*; and (3) each of the corner segments 130*e*, 130*f*, 130*g*, 130*h* of the trim panel 130 includes, respectively, zero passages. Accordingly, the trim panel 130 may include a total of sixteen passages 138 extending through the thickness of the trim panel 130 along the outer periphery of the trim panel 130.

Comparatively, the trim panel 30 of FIGS. 5A-5B and the trim panel 130 of FIGS. 6A-6B are substantially similar except for the respective arrangement of the one or more passages 38, 138. For example, the trim panel 138 of FIGS. 6A-6B does not include one or more passages extending through the thickness of the trim panel 130 along the outer periphery of the corner segments 130*e*, 130*f*, 130*g*, 130*h* whereas the trim panel 30 includes one passage 38*e*, 38*f*, 38*g*, 38*h* extending through the thickness $T_{30}$ of the trim panel 30 along the outer periphery of the corner segments 30*e*, 30*f*, 30*g*, 30*h*). Furthermore, in another example, the trim panel 130 includes five passages 138*b*, 138*d* extending through the thickness of the trim panel 130 along the outer periphery of the side segments 130*b*, 130*d* whereas the trim panel 30 includes four passage 38*b*, 38*d* extending through the thickness $T_{30}$ of the trim panel 30 along the outer periphery of the side segments 30*b*, 30*d*. Accordingly, the total number of passages 38, 138 of each of the trim panels 30, 130 differ by two in that the trim panel 30 includes a total of eighteen passages and the trim panel 130 includes a total of sixteen passages.

Because the trim panel 130 of FIGS. 6A-6B includes a different arrangement and also a different amount of passages 138 in comparison to the trim panel 30, a corresponding frame (not shown) having an arrangement of lugs (not shown) and a corresponding container (not shown) would cooperate with the trim panel 130 for forming an assembly. Accordingly, if, for example, the user U attempted to incorporate the trim panel 130 with one or both of the frame 12 and the first shell half 42 of the container 40, the trim panel 130 would fail to mate with both of the frame 12 and the first shell half 42 of the container 40 as a result of failing to 'axially-key together' as a result of not being able to provide each of the first axially-keyed configuration and the second axially-keyed configuration described above. Accordingly, with respect to the design of the assembly 10, the arrangement of the passages 30 of the trim panel 30 may provide for a proprietary design that prevents some trim panels (e.g., the trim panel 130) from being incorporated into the first subassembly 10*a* and/or the second subassembly 10*b* of the assembly 10.

Yet even further, with continued reference to FIGS. 5A-5B and 6A-6B, the location of the passages 38, 138 is not limited to the outer periphery of the trim panels 30, 130 defined by the outer side surfaces 36, 136. For example, one or both the trim panels 30, 130 may include one or more passages 38', 138' that extends through the thickness of the trim panels 30, 130 but not into the outer side surfaces 36, 136 of the trim panels 30, 130.

Referring to FIGS. 7A-7D, an exemplary assembly 200 and exemplary subassemblies 210*a*, 210*b*, 210*c* are shown. The components of the assembly 200 and the subassemblies 210*a*, 210*b*, 210*c* are substantially similar to the assembly 10 and the subassemblies 10*a*, 10*b*, 10*c*, and, therefore, for purposes of brevity, are not described in greater detail here. However, the assembly 200 and the subassemblies 210*a*, 210*b*, 210*c* include one or more fasteners 270 that may differ from the one or more fasteners 70 of the assembly 10 and the subassemblies 10*a*, 10*b*, 10*c*.

In some implementations, the one or more fasteners 270 may be secured to the rear surface 264 of the support panel 250 of the first shell half 242 of the container 240 by a tether 271. Although the one or more fasteners 270 are generally represented by a 'box' having a length $L_{274}$, the one or more fasteners 270 may include any desirable configuration (e.g., a threaded fastener, a snap fastener, a magnet or the like). The one or more fasteners 270 function similarly to the one or more fasteners 70 in that the one or more fasteners 270 selectively-secure the frame 212 of the first subassembly 210*a* to the first shell half 242 of the container 240 while containing the trim panel 230 there-between.

Referring to FIGS. 8A-8D, an exemplary assembly 300 and exemplary subassemblies 310*a*, 310*b*, 310*c* are shown. The components of the assembly 300 and the subassemblies 310*a*, 310*b*, 310*c* are substantially similar to the assembly 10 and the subassemblies 10*a*, 10*b*, 10*c*, and, therefore, for purposes of brevity, are not described in greater detail here. However, the assembly 300 and the subassemblies 310*a*, 310*b*, 310*c* include one or more fasteners 370 that may differ from the one or more fasteners 70 of the assembly 10 and the subassemblies 10*a*, 10*b*, 10*c*.

The one or more fasteners 370 may be secured to the rear surface 364 of the support panel 350 of the first shell half 342 of the container 340 by a hinge 371, a magnetic force, or the like. Although the one or more fasteners 370 are generally represented by a 'box', the one or more fasteners 370 may include any desirable configuration (e.g., a snap fastener, a magnet, or the like). The one or more fasteners 270 function similarly to the one or more fasteners 70 in that the one or more fasteners 370 selectively-secure the frame 312 of the first subassembly 310*a* to the first shell half 342 of the container 340 while containing the trim panel 230 there-between.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The schematic flow chart diagrams included herein are generally set forth as logical flow chart diagrams. As such, the depicted order and labeled steps are indicative of one or more embodiments of the presented method. The steps recited in any of the method or process descriptions may be executed in any order and are not necessarily limited to the order presented, unless otherwise specified. Furthermore, any reference to singular includes plural embodiments, and any reference to more than one component or step may include a singular embodiment or step. Elements and steps in the figures are illustrated for simplicity and clarity and have not necessarily been rendered according to any particular sequence. Other steps and methods may be conceived that are equivalent in function, logic, or effect to one or more steps, or portions thereof, of the illustrated method.

Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown. Furthermore, no element, component, or method step in the present disclosure is intended to be dedicated to the public regardless of whether the element, component, or method step is explicitly recited in the claims.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An assembly comprising:

(i) a first subassembly including:

a frame removably-connected to a trim panel, wherein the frame has a frame front surface and a frame rear surface, wherein the trim panel has a trim panel front surface and a trim panel rear surface, wherein the frame rear surface is arranged opposite one of:

the trim panel front surface; and the trim panel rear surface;

wherein the frame includes one or more lugs that extend from the frame rear surface;

wherein the trim panel includes one or more trim panel passages that extend through the trim panel, wherein the frame is removably-connected to the trim panel by arranging the one or more lugs of the frame though the one or more trim panel passages, wherein a portion of the one or more lugs extend beyond the trim panel rear surface;

(ii) a container having a container front surface and a container rear surface, wherein the container includes one or more container passages that extend through the container, wherein the trim panel rear surface is arranged opposite the container front surface, wherein the portion of the one or more lugs that extend beyond the rear surface of the trim panel is arranged within the one or more container passages of the container for connecting the first subassembly to the container for forming a second subassembly;

(iii) one or more fasteners, wherein the one or more fasteners are connected to:

the one or more lugs; and the container for selectively-securing and removably-connecting the frame to the container;

wherein the one or more fasteners do not penetrate through the frame front surface.

2. The assembly of claim 1, wherein the one or more lugs of the frame is friction-fit connected to:

the one or more trim panel passages of the trim panel; and the one or more container passages of the container.

3. The assembly of claim 1, wherein the one or more fasteners include a threaded fastener having a head portion and a threaded stem portion extending from the head portion.

4. The assembly of claim 3, wherein the one or more lugs include a threaded surface that defines a threaded cavity, wherein the threaded stem portion is disposed within the threaded cavity, wherein the head portion is disposed opposite the container rear surface.

5. The assembly of claim 1, wherein the one or more fasteners include a snap fastener.

6. The assembly of claim 5, wherein the snap fastener is connected to the container rear surface by a tether or hinge.

7. The assembly of claim 1, wherein the one or more fasteners include a magnet.

8. The assembly of claim 7, wherein the magnet is connected to the container rear surface by a tether or hinge.

9. The assembly of claim 1, wherein the frame further includes a frame inner side surface that connects the frame front surface to the frame rear surface, wherein the frame inner side surface defines a frame opening.

10. The assembly of claim 9 further comprising:

a first design arranged upon the trim panel front surface; and a second design arranged upon the trim panel rear surface.

11. The assembly of claim 10, wherein the trim panel front surface includes:

a first surface portion; and a second surface portion, wherein at least the second surface portion of the trim panel front surface includes the first design, wherein the frame rear surface is arranged opposite at least the first portion of the trim panel front surface, wherein the frame opening exposes the first design included on at least the second surface portion of the trim panel front surface.

12. The assembly of claim 10, wherein the trim panel rear surface includes:

a first surface portion; and a second surface portion, wherein at least the second surface portion of the trim panel rear surface includes the second design, wherein the frame rear surface is arranged opposite at least the first portion of the trim panel rear surface, wherein the frame opening exposes the second design included on at least the second surface portion of the trim panel rear surface.

13. A method for assembling an assembly, wherein the assembly comprises:

(i) a first subassembly including a frame removably-connected to a trim panel, wherein the frame includes a frame front surface and a frame rear surface, wherein the frame further includes one or more lugs that extend from the frame rear surface, wherein the trim panel includes a trim panel front surface and a trim panel rear surface, wherein the trim panel further includes one or more trim panel passages that extend through the trim panel;

(ii) a container having a container front surface and a container rear surface, wherein the container includes one or more container passages that extend through the container;

(iii) one or more fasteners;

wherein the method comprises:

(a) assembling the first subassembly by:

arranging the frame rear surface opposite one of:

the trim panel front surface; and the trim panel rear surface;

wherein the frame is removably-connected to the trim panel by:

arranging the one or more lugs of the frame though the one or more trim panel passages for removably connecting the frame to the trim panel;

arranging a portion of the one or more lugs extend beyond the trim panel rear surface;

(b) arranging the trim panel rear surface opposite the container front surface;

(c) arranging the portion of the one or more lugs that extend beyond the rear surface of the trim panel within the one or more container passages of the container for connecting the first subassembly to the container for forming a second subassembly;

(d) selectively-securing the frame to the container with the one or more fasteners;

wherein the one or more fasteners do not penetrate through the frame front surface.

14. The method of claim 13 further comprising:

friction-fit connecting the one or more lugs of the frame to:

the one or more trim panel passages of the trim panel; and the one or more container passages of the container.

15. The method of claim 13 further comprising:

arranging a first design upon the trim panel front surface; and arranging a second design upon the trim panel rear surface, wherein the trim panel front surface includes a first surface portion and a second surface portion, wherein at least the second surface portion of the trim panel front surface includes the first design, wherein the method further includes:

arranging the frame rear surface opposite at least the first portion of the trim panel front surface; and utilizing the frame opening for exposing the first design included on at least the second surface portion of the trim panel front surface.

16. The method of claim 13 further comprising:

arranging a first design upon the trim panel front surface; and arranging a second design upon the trim panel rear surface, wherein the trim panel rear surface includes a first surface portion and a second surface portion, wherein at least the second surface portion of the trim panel rear surface includes the second design, wherein the method further includes:

arranging the frame rear surface opposite at least the first portion of the trim panel rear surface; and utilizing the frame opening for exposing the second design included on at least the second surface portion of the trim panel rear surface.

* * * * *